US010426996B1

(12) United States Patent
Brumit

(10) Patent No.: US 10,426,996 B1
(45) **Date of Patent: *Oct. 1, 2019**

(54) REHABILITATION MACHINE AND APPARATUS

(71) Applicant: Kent Brumit, Pulaski, TN (US)

(72) Inventor: Kent Brumit, Pulaski, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/026,308

(22) Filed: Jul. 3, 2018

Related U.S. Application Data

(63) Continuation of application No. 15/584,321, filed on May 2, 2017, now Pat. No. 10,010,745, which is a continuation-in-part of application No. 15/396,556, filed on Dec. 31, 2016, now Pat. No. 9,636,539, which is a continuation-in-part of application No. 14/725,717, filed on May 29, 2015, now abandoned.

(51) Int. Cl.

| | |
|---|---|
| ***A63B 22/00*** | (2006.01) |
| ***A63B 21/22*** | (2006.01) |
| ***A63B 21/00*** | (2006.01) |
| ***A63B 22/06*** | (2006.01) |

(52) U.S. Cl.
CPC ..... *A63B 22/0002* (2013.01); *A63B 21/22* (2013.01); *A63B 21/4035* (2015.10); *A63B 22/0605* (2013.01)

(58) Field of Classification Search
CPC ..... A63B 22/00; A63B 22/06; A63B 22/0002; A63B 22/001; A63B 22/0012; A63B 23/035; A63B 22/0605; A63B 2022/0652; A61H 1/0266; A61H 1/0285
See application file for complete search history.

(56) References Cited

U.S. PATENT DOCUMENTS

| | | | | | |
|---|---|---|---|---|---|
| 3,572,699 | A | * | 3/1971 | Nies | A61B 5/221 482/5 |
| D255,348 | S | * | 6/1980 | Ott | D13/115 |
| 4,402,502 | A | * | 9/1983 | Peters | A61H 1/0214 482/139 |
| 4,436,097 | A | * | 3/1984 | Cunningham | A61B 5/221 482/62 |
| 4,529,195 | A | * | 7/1985 | Stevens | A63B 5/20 482/1 |
| 4,572,501 | A | * | 2/1986 | Durham | A63B 22/001 280/250.1 |
| 4,846,156 | A | * | 7/1989 | Kopnicky | A61H 1/0214 601/36 |
| 4,976,426 | A | * | 12/1990 | Szabo | A63B 21/00178 482/111 |

(Continued)

*Primary Examiner* — Garrett K Atkinson
(74) *Attorney, Agent, or Firm* — Wayne Edward Ramage Baker Donelson

(57) ABSTRACT

An apparatus for providing therapeutic rehabilitation exercise to bedridden individuals and patients, including comatose individuals. A vertical support column extends upwards from a base, with one or more arms extend from the vertical support column, each providing a rotary mechanism at the distal end, with pedals or handles attached thereto. The individual's feet or hands are secured to the pedals or handles, respectively. Straps, brackets, or other fastening means may be used to secure the feet and hands. An electric motor causes the rotary mechanism to move the pedals or handles in a rotary fashion, thereby providing movement and exercise for the individual's legs and arms.

15 Claims, 26 Drawing Sheets

(56) References Cited

U.S. PATENT DOCUMENTS

| | | | | | |
|---|---|---|---|---|---|
| 5,044,627 | A * | 9/1991 | Huang | A63B 22/0002 | 482/115 |
| 5,330,402 | A * | 7/1994 | Johnson | A63B 22/0012 | 482/52 |
| 5,569,128 | A * | 10/1996 | Dalebout | A63B 22/0007 | 482/57 |
| 5,857,943 | A * | 1/1999 | Murray | A63B 22/0012 | 482/57 |
| 5,906,563 | A * | 5/1999 | Pittari | A63B 21/157 | 482/57 |
| 5,980,431 | A * | 11/1999 | Miller, Jr. | A63B 22/0007 | 482/57 |
| 6,036,623 | A * | 3/2000 | Mitchell | A63B 23/03575 | 482/57 |
| 7,727,125 | B2 * | 6/2010 | Day | A63B 21/015 | 482/5 |
| 7,789,808 | B2 * | 9/2010 | Lee | A63B 22/0007 | 482/57 |
| 8,968,162 | B2 * | 3/2015 | Jaguan | A63B 71/023 | 482/57 |
| 9,592,421 | B2 * | 3/2017 | Eder | A63B 22/0005 | |
| 2005/0143226 | A1 * | 6/2005 | Heidecke | A63B 21/0053 | 482/62 |
| 2006/0094569 | A1 * | 5/2006 | Day | A63B 21/015 | 482/57 |
| 2006/0247106 | A1 * | 11/2006 | Peavey | A63B 24/0003 | 482/83 |
| 2008/0085819 | A1 * | 4/2008 | Yang | A63B 21/015 | 482/62 |
| 2008/0134434 | A1 * | 6/2008 | Celauro | A61H 1/02 | 5/610 |

* cited by examiner

REHABILITATION MACHINE AND APPARATUS

This application is a continuation of U.S. patent application Ser. No. 15/584,321, filed May 2, 2017, which is a continuation-in-part application of U.S. patent application Ser. No. 15/396,556, filed Dec. 31, 2016, which is a continuation-in-part application of U.S. patent application Ser. No. 14/725,717, filed May 29, 2015 by Kent Brumit, and is entitled to benefit of those filing dates for priority. The specifications, figures, and complete disclosures of U.S. application Ser. Nos. 14/725,717 and 15/396,556 and 15/584,321 are incorporated herein in their entireties by specific reference for all purposes.

FIELD OF INVENTION

This invention relates to a machine and apparatus for providing therapeutic rehabilitation exercise to bedridden individuals and patients, including comatose individuals.

SUMMARY OF INVENTION

In various embodiments, the present invention comprises an apparatus for providing therapeutic rehabilitation exercise to bedridden individuals and patients, including comatose individuals. The apparatus comprises a vertical support column extending upwards from a base. One or more arms extend from the vertical support column, each providing a rotary mechanism at the distal end, with pedals or handles attached thereto.

For general operation, the individual's feet or hands are secured to the pedals or handles, respectively. Straps, brackets, or other fastening means may be used to secure feet and hands to the respective pedals or handles An electric motor causes the rotary mechanism to move the pedals or handles in a rotary fashion, thereby providing movement and exercise for the individual's legs and arms. The legs and arms can be exercised separately, individually, or together simultaneously.

In one exemplary embodiment, a plurality of wheels, casters or rollers are provided under the base, thereby allowing the apparatus to be moved from location to location. One or more of the wheels may be multi-directional or omni-directional. One or more of the wheels may be lockable, to allow the apparatus to be fixed in place at a desired location. Alternatively, one or more stands or brackets may be lowered to the ground to firmly secure the apparatus in place and prevent movement during use.

In one embodiment, the vertical support column extends upward from proximate to one end of the base. This allows a portion of the base to be placed under a bed or other piece of furniture, providing easier access to the pedals or handles for an individual in the bed or piece of furniture.

In one embodiment, the motor may be located on the base, and power is provided by an electrical cord, which may be plugged into a standard electrical outlet, or a battery, or a combination thereof. The battery may be a rechargeable battery, and recharged by plugging the apparatus into a standard electrical outlet.

The rotary mechanisms are rotated by the motor through one or more chains, cables, belts and/or pulley/gear linkages. The chains, cables, belts and/or pulley/gear linkages may be located internally in the support column and arms, externally to the support column and arms, or combinations thereof. In one embodiment, the rotary mechanisms rotate together, although separate linkages may be provided so that a single motor operates both rotary mechanisms independently.

In an alternative embodiment, the electrical motor can be located inside the column. Multiple motors also may be used. For example, in another embodiment, one or more electrical motors may be located at the proximal end of each arm (either internal or external, or a combination thereof). In yet another embodiment, electrical motors may be located at the distal end of each arm, and may be directly connected to the rotary mechanisms.

In several exemplary embodiments, a control panel allows the operator to control operation of the apparatus. From the control panel, the operator can control the direction and speed of each rotary mechanism. In one embodiment, the operator can set a timer for each rotary mechanism, whereby the rotary mechanism is shut down after a certain period of time. In another embodiment, the operator can set a program sequence for a rotary mechanism, whereby speed, direction, and time can be varied. The operator can set a custom sequence, or may choose from one or more pre-programmed sequences.

The operator may control the apparatus directly through the control panel interface. Alternatively, an operator may use a control application on computing device, including, but not limited to, a smart phone, tablet, personal computer, or mobile computing device, to interface with the apparatus, wired or wirelessly.

In several embodiments, the arms rotate or swing around the support column. Arms also may be lowered or raised in height. This facilitates the exact positioning of the rotary mechanisms for use with a particular individual, as well as helping with the use of one arm and accompanying rotary mechanism at a time. In yet another embodiment, the arms may be jointedly connected to the support column, whereby an arm can be unlocked at the joint and the distal end of the arm moved downward so that the arm rests parallel to the support column.

DETAILED DESCRIPTION OF EXEMPLARY EMBODIMENTS

Figure 1:
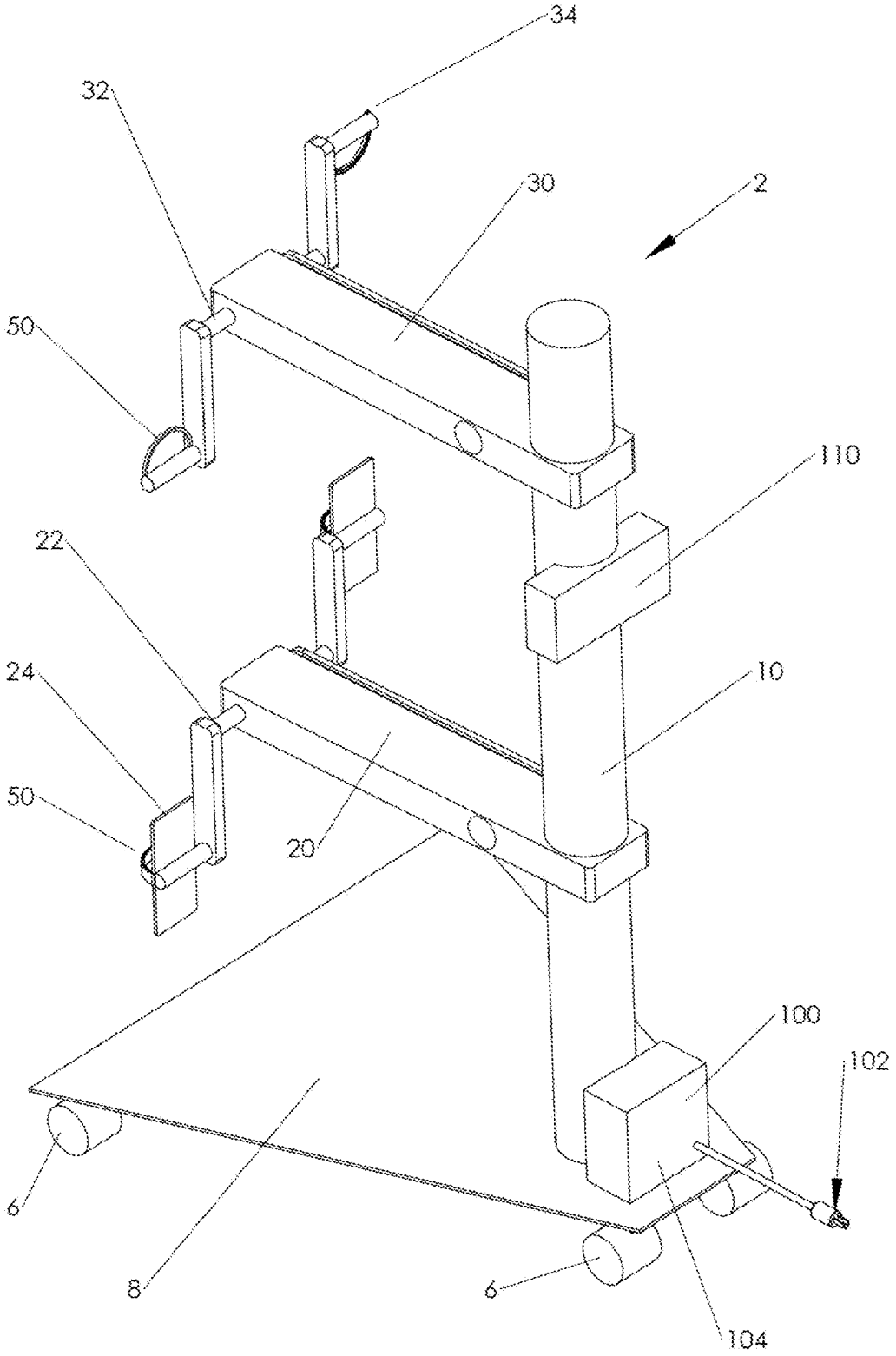
FIG. 1 shows a perspective view of an apparatus in accordance with an embodiment of the present invention.
Figure 2:
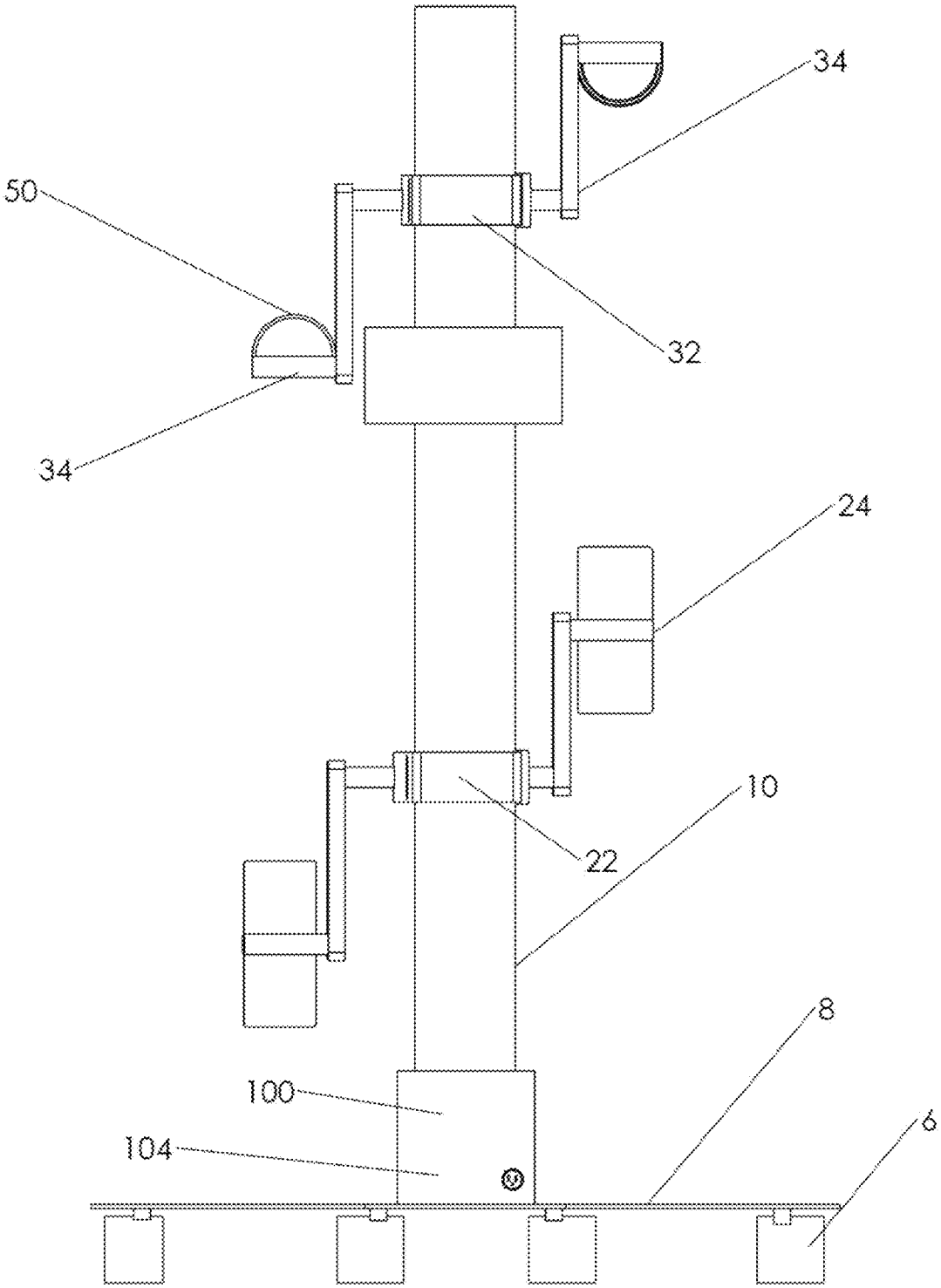
FIG. 2 shows a front view of the apparatus of FIG. 1.
Figure 3:
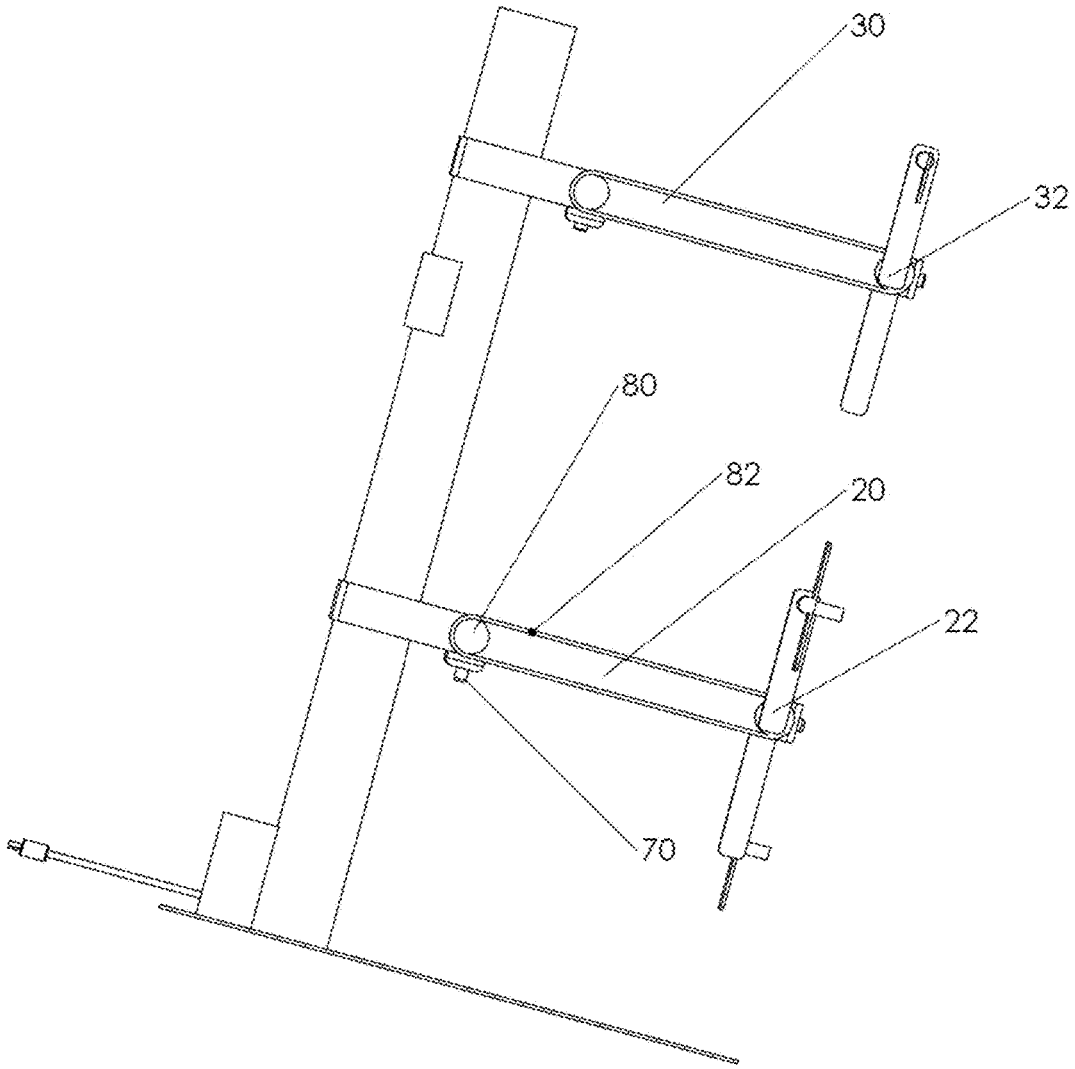
FIG. 3 shows a side view of the apparatus of FIG. 1.

In various exemplary embodiments, as seen in FIGS. 1-7, the present system comprises an apparatus 2 for providing therapeutic rehabilitation exercise to bedridden individuals and patients, including comatose individuals. The apparatus comprises a vertical support column 10 extending upwards from a base 8. One or more arms 20, 30 extend from the vertical support column 10, providing a rotary mechanism 22, 32 at the distal end, with pedals 24 or handles 34 attached thereto. For general operation, the individual's feet or hands are secured to the pedals 24 or handles 34, respectively, through use of straps, brackets, or other fastening means 50. An electric motor 100 causes the rotary mechanism to move the pedals or handles in a rotary fashion, in either direction, thereby providing movement and exercise for the individual's legs and arms. The legs and arms can be exercised separately, individually, or together simultaneously.

In several exemplary embodiments, as seen in FIGS. 20-26, a pedal comprises comprise a base plate 210 with a heel plate 220 at one end to receive and hold the foot of the individual. The base plate is rotatably connected 230 to the respective rotary mechanism. A calf strap 240 is strapped around the calf of the leg to help hold the foot of the individual in place on the pedal. The calf strap may be a single piece, with the foot and leg inserted therein, or may be a strap that can be opened and closed, such as with a buckle. The strap may be adjustable in radius to accommodate different leg sizes.

Figure 24:
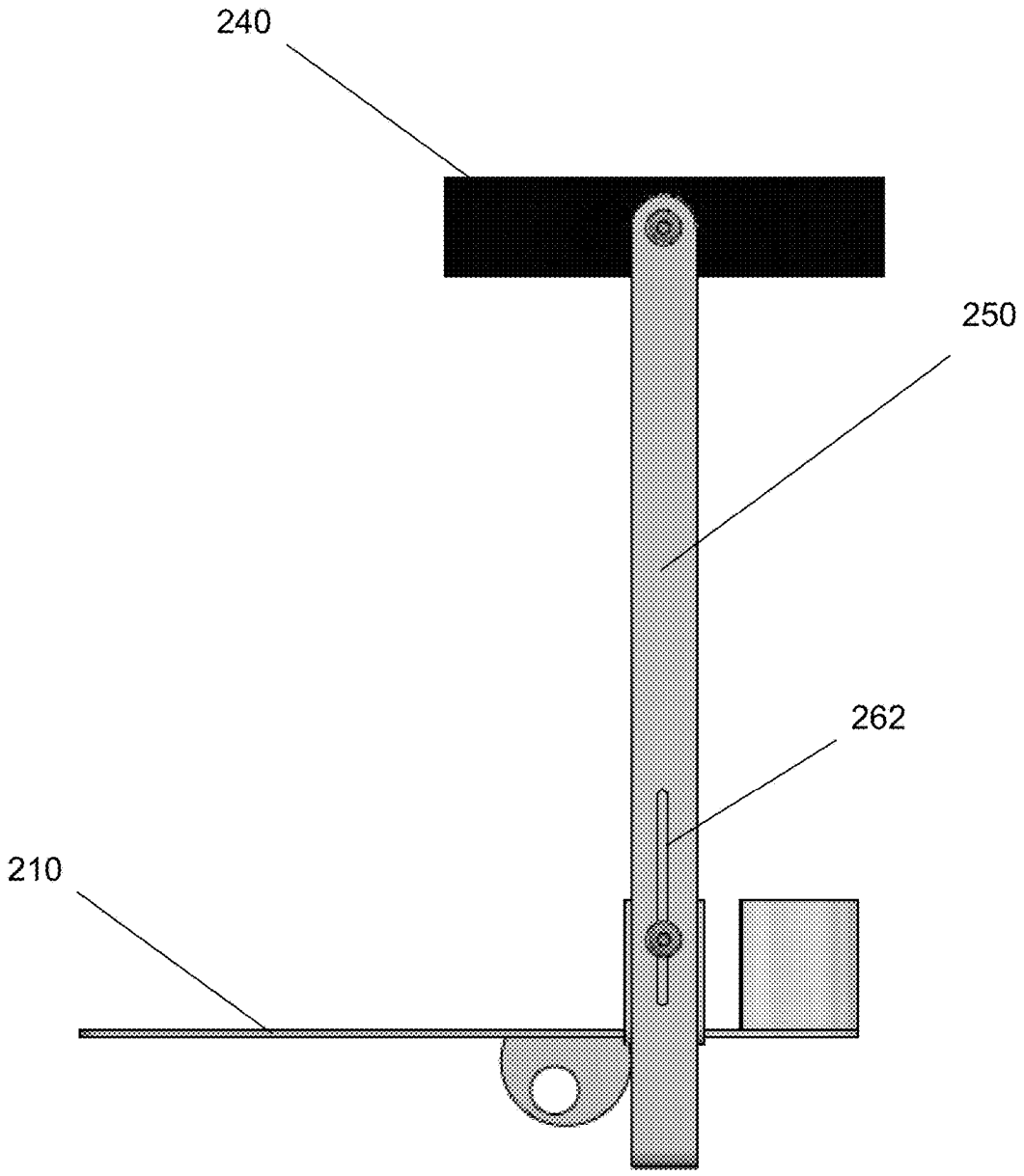
FIG. 24 shows a left side view of the apparatus of FIG. 20.
Figure 25:
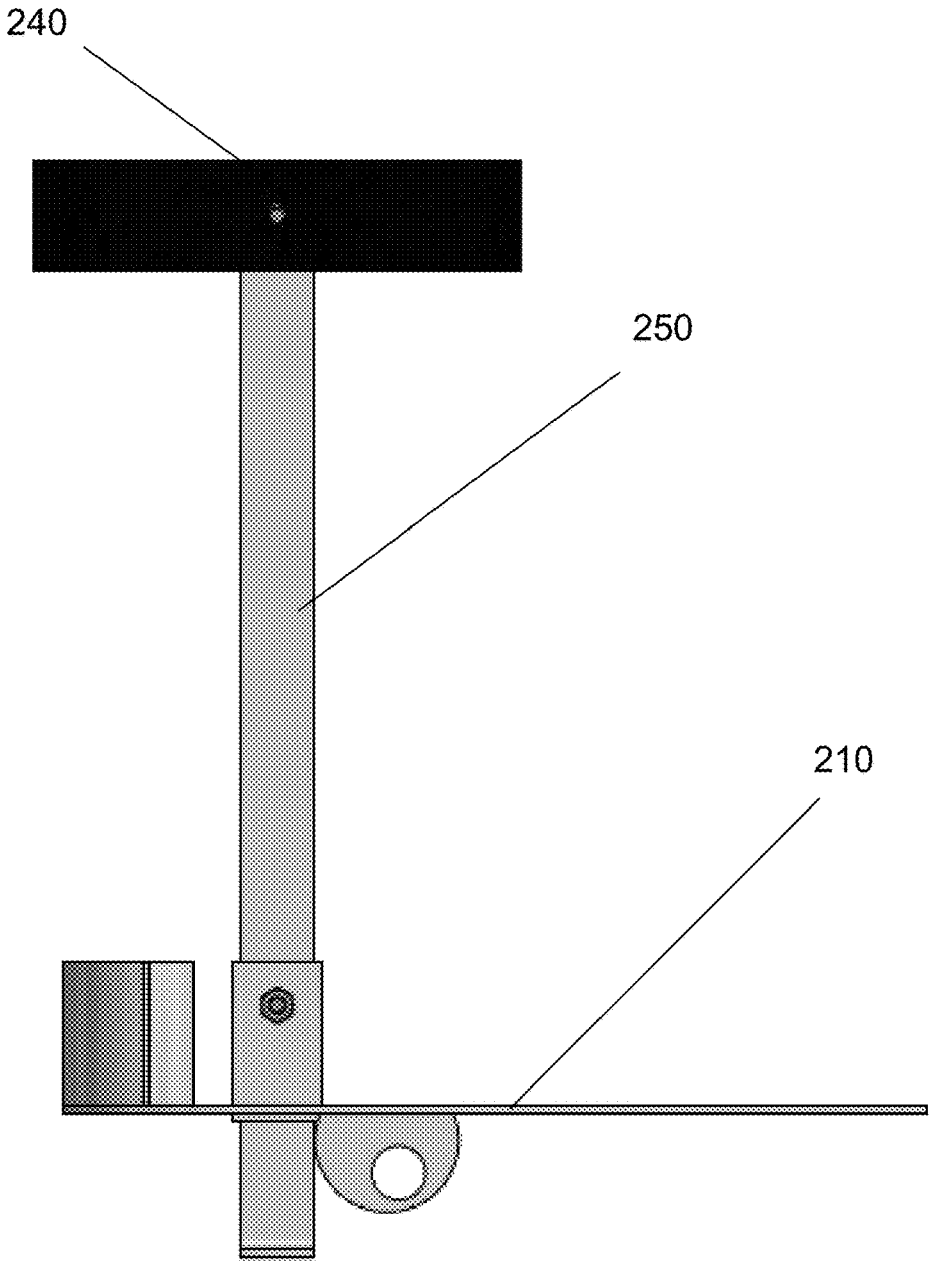
FIG. 25 shows a right side view of the apparatus of FIG. 20.
Figure 26:
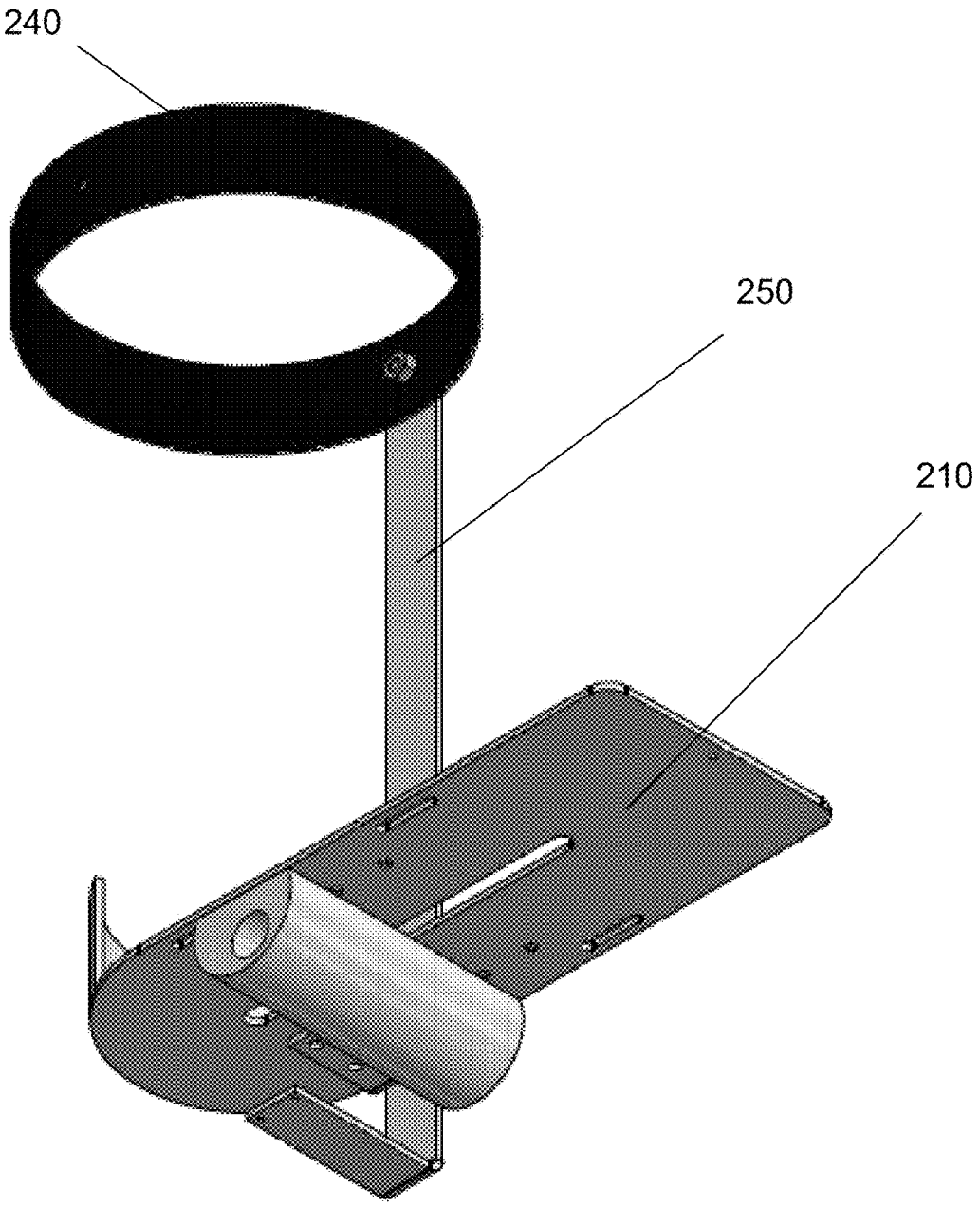
FIG. 26 shows a bottom perspective view of the apparatus of FIG. 20.

The strap may be attached to one end of a strap bar 250. The attachment means may be a screw, nut and bolt, or other means known in the art. The strap bar is attached proximal to its other end to the base plate or a strap bar mount on the base plate. The attachment may be by means of a screw, nut and bolt 260, a snap-lock connection, or other attachment means known in the art. The strap bar may be adjustably connected to the base plate, or strap, or both, so that the distance between the strap and the base plate may be adjusted to accommodate different leg lengths and sizes. As seen in FIG. 24, the nut or screw is located within a channel 252 and may be loosened so that the strap bar may be moved up and down to the desired position and the nut or screw retightened. Alternatively, a series of holes in the strap bar may be provided for the same purpose, wherein the strap bar may be moved up and down to the desired position where the strap bar hole matches a corresponding hold on the base plate or a strap bar mount on the base plate.

It should be noted that the strap bar may be attached to the base plate in a variety of locations. In several embodiments, as shown, the strap bar may be attached to the right or left side of the base plate, proximate the heel plate, so that the strap bar runs parallel to the leg. The strap bar may run to the inside or the outside of the leg during to accommodate variations in leg configuration or geometry.

In one exemplary embodiment, a plurality of wheels, casters or rollers 6 are provided under the base, thereby allowing the apparatus to be moved from location to location. One or more of the wheels 6 may be multi-directional or omni-directional. One or more of the wheels 6 may be lockable, to allow the apparatus to be fixed in place at a desired location. Alternatively, one or more stands or brackets may be lowered to the ground to firmly secure the apparatus in place and prevent movement during use.

In one embodiment, the vertical support column 10 extends upward from proximate to one end of the base 8. This allows a portion of the base to be placed under a bed or other piece of furniture, providing easier access to the pedals or handles for an individual in the bed or piece of furniture, as well as providing a stable base of support when the arms are extended over the base. The base may be weighted. The apparatus also may be attached to the bed or piece of furniture for stability, and to hold the apparatus securely in place when in use. The support column may be telescoping, allowing portions of the column (including the arms) to be raised or lowered.

In one embodiment, the motor 100 may be located on the base, and power is provided by an electrical cord 102, which may be plugged into a standard electrical outlet, or a battery 104, or a combination thereof. The battery may be a rechargeable battery, and recharged by plugging the apparatus into a standard electrical outlet. A power switch or button or control may be provided to turn the apparatus on and off.

The rotary mechanisms 22, 32 are rotated by the motor through one or more chains, cables, belts 82 and/or pulley/gear linkages 80. The chains, cables, belts and/or pulley/gear linkages may be located internally in the support column and arms, externally to the support column and arms, or combinations thereof. In one embodiment, the rotary mechanisms 22, 32 rotate together, although separate linkages may be provided so that a single motor operates both rotary mechanisms independently.

In an alternative embodiment, the electrical motor can be located inside the column. Multiple motors also may be used. For example, in another embodiment, one or more electrical motors may be located at the proximal end of each arm (either internal or external, or a combination thereof). In yet another embodiment, electrical motors may be located at the distal end of each arm, and may be directly connected to the rotary mechanisms.

Figure 4:
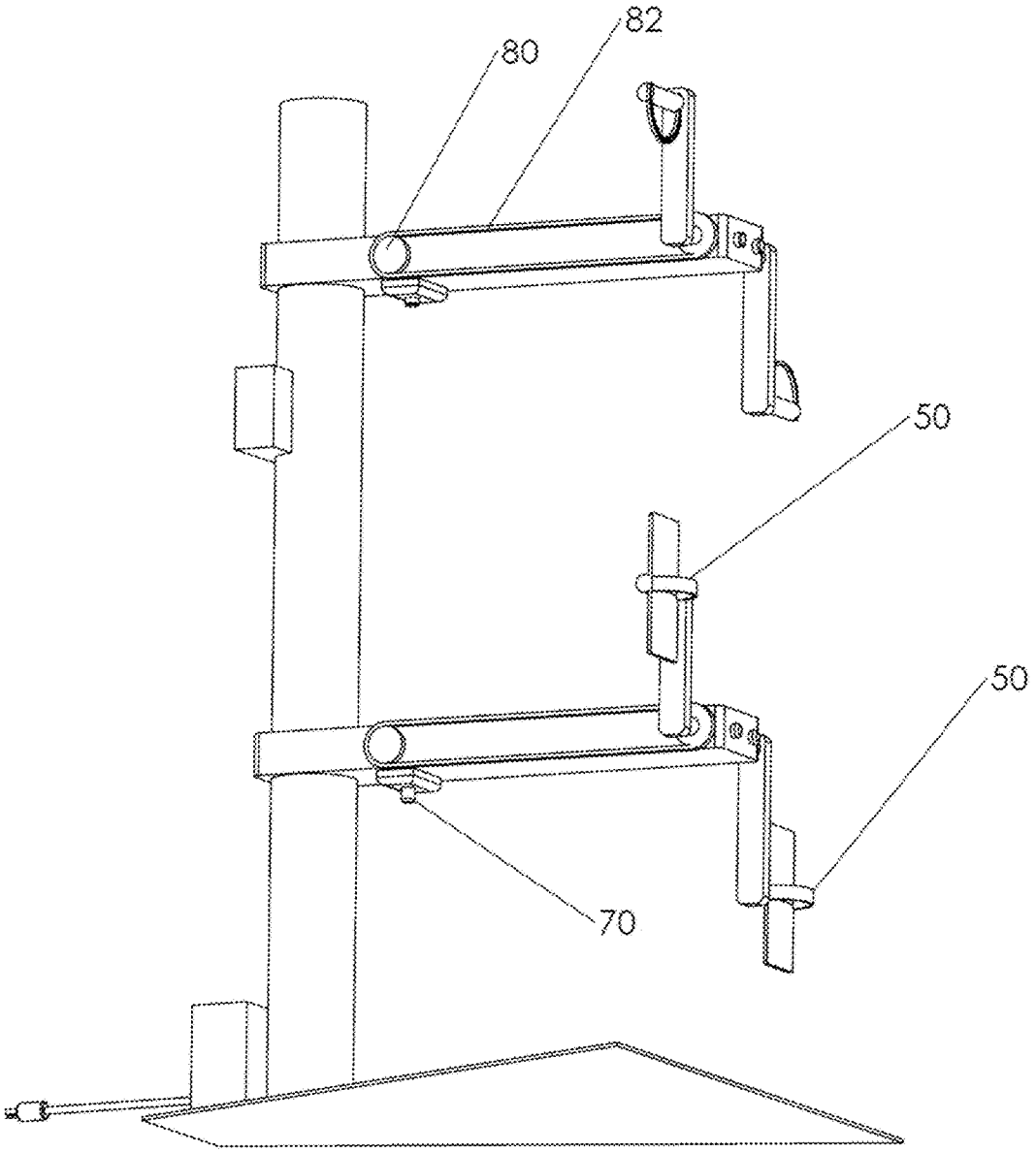
FIG. 4 shows a bottom perspective view of the apparatus of FIG. 1.
Figure 5:
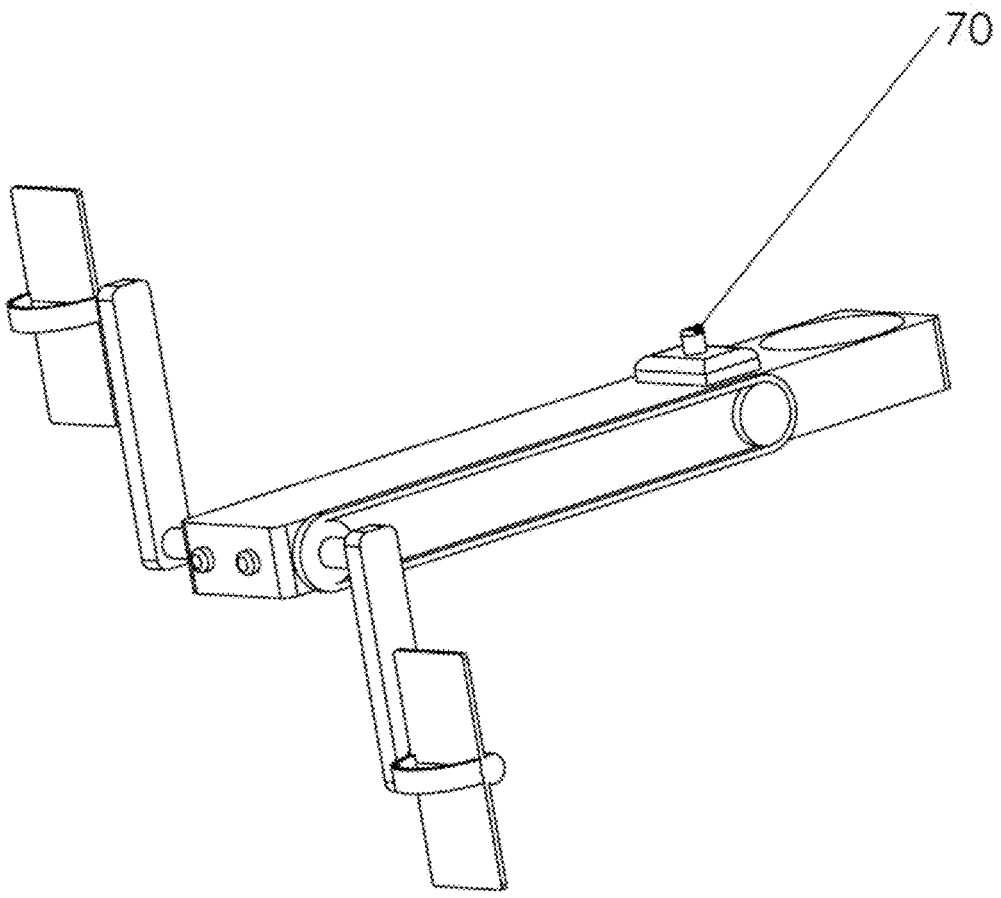
FIG. 5 shows a view of the pedal arm of the apparatus of FIG. 1.
Figure 6:
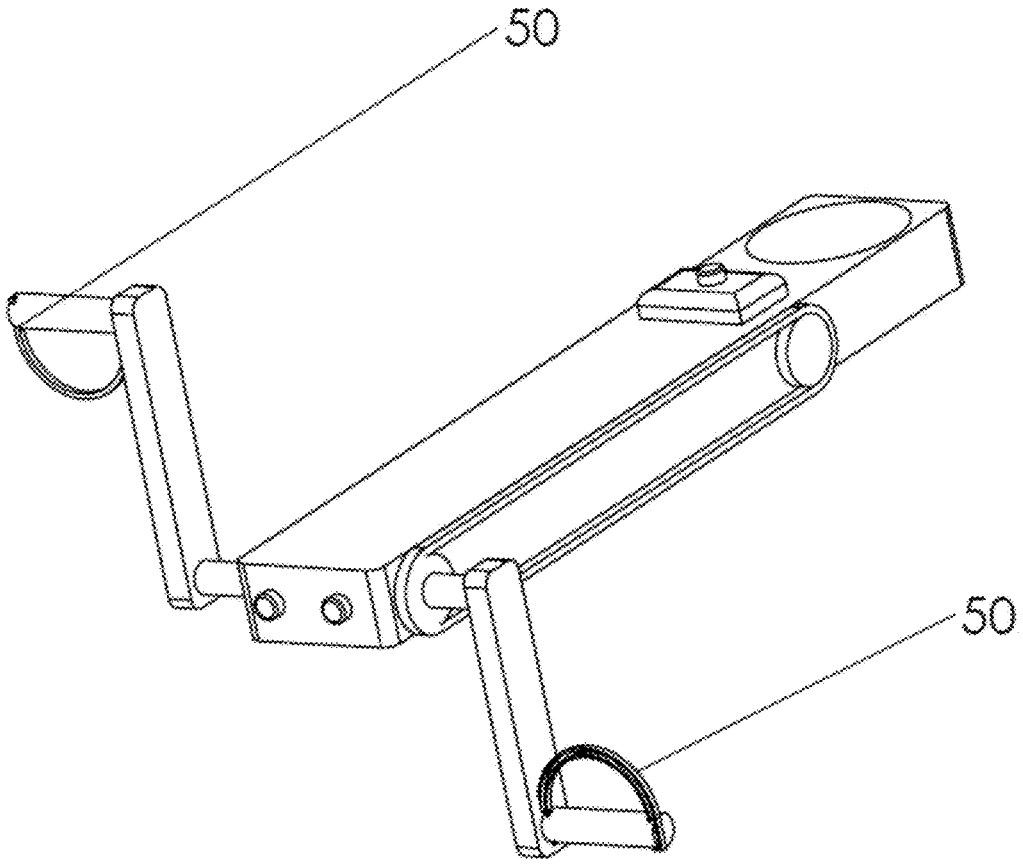
FIG. 6 shows a view of the handle arm of the apparatus of FIG. 1.

In several exemplary embodiments, a control panel 110 allows the operator to control operation of the apparatus. From the control panel, the operator can control the direction and speed of each rotary mechanism. In an alternative embodiment, a speed control or dial 70 may be located elsewhere on the apparatus, such as on the arms, as seen in FIG. 4.

In one embodiment, the operator can use the control panel or other control to set a timer for each rotary mechanism, whereby the rotary mechanism is shut down after a certain period of time. In another embodiment, the operator can set a program sequence for a rotary mechanism, whereby speed, direction, and time can be varied. The operator can set a custom sequence, or may choose from one or more pre-programmed sequences. For example, a sequence for the handle rotary mechanism may be as follows: rotate direction 1 for 3 minutes at low speed, rotate direction 1 for 2 minutes at medium speed, rotate direction 1 for 1 minute at low speed, 30 second rest stop, rotate direction 2 (reverse) for 3 minutes at low speed, stop.

The operator may control the apparatus directly through the control panel interface 110. Alternatively, an operator may use a control application on computing device, including, but not limited to, a smart phone, tablet, personal computer, or mobile computing device, to interface with the apparatus, wired or wirelessly.

Figure 7:
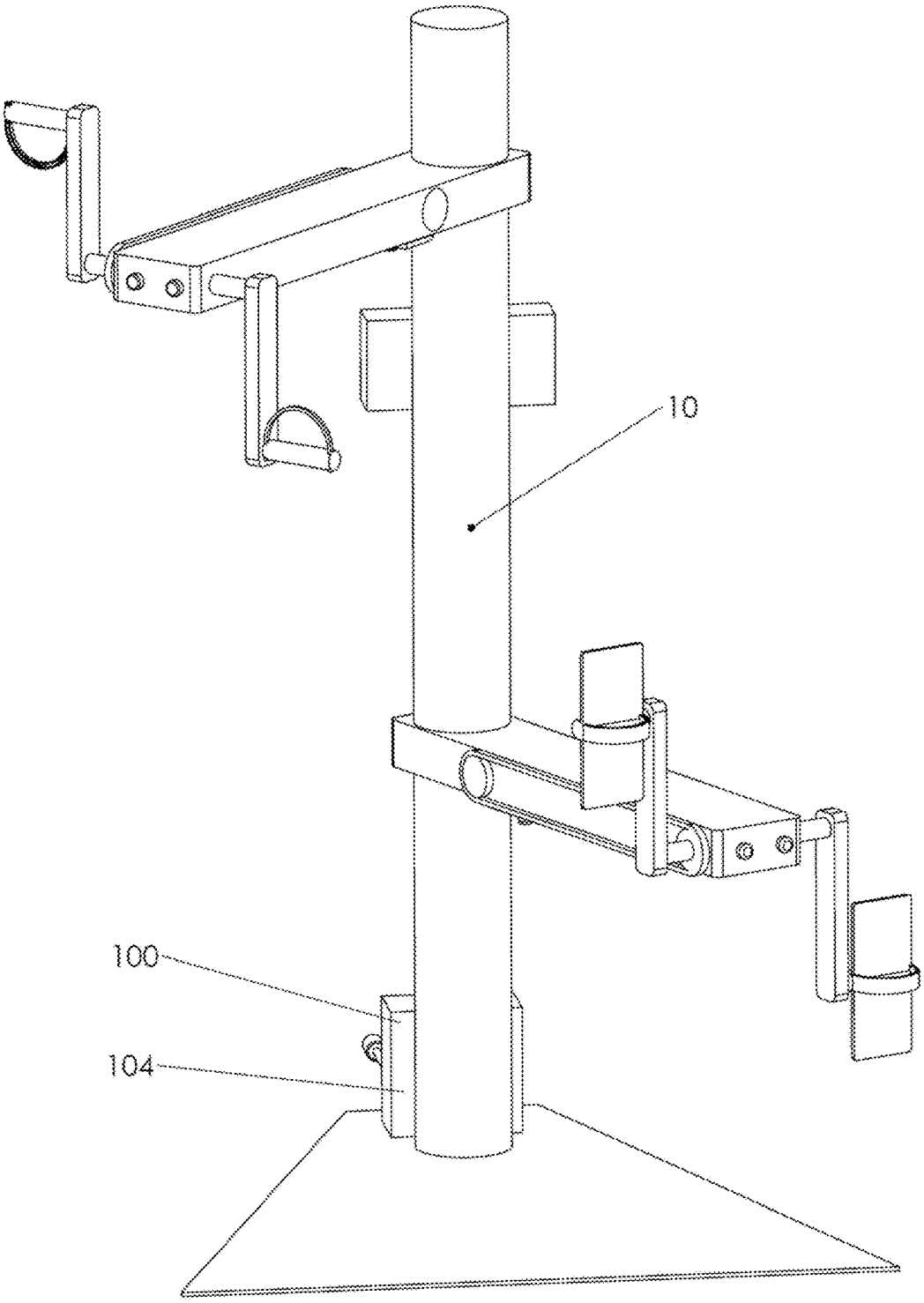
FIG. 7 shows another perspective view of the apparatus of FIG. 1.
Figure 8:
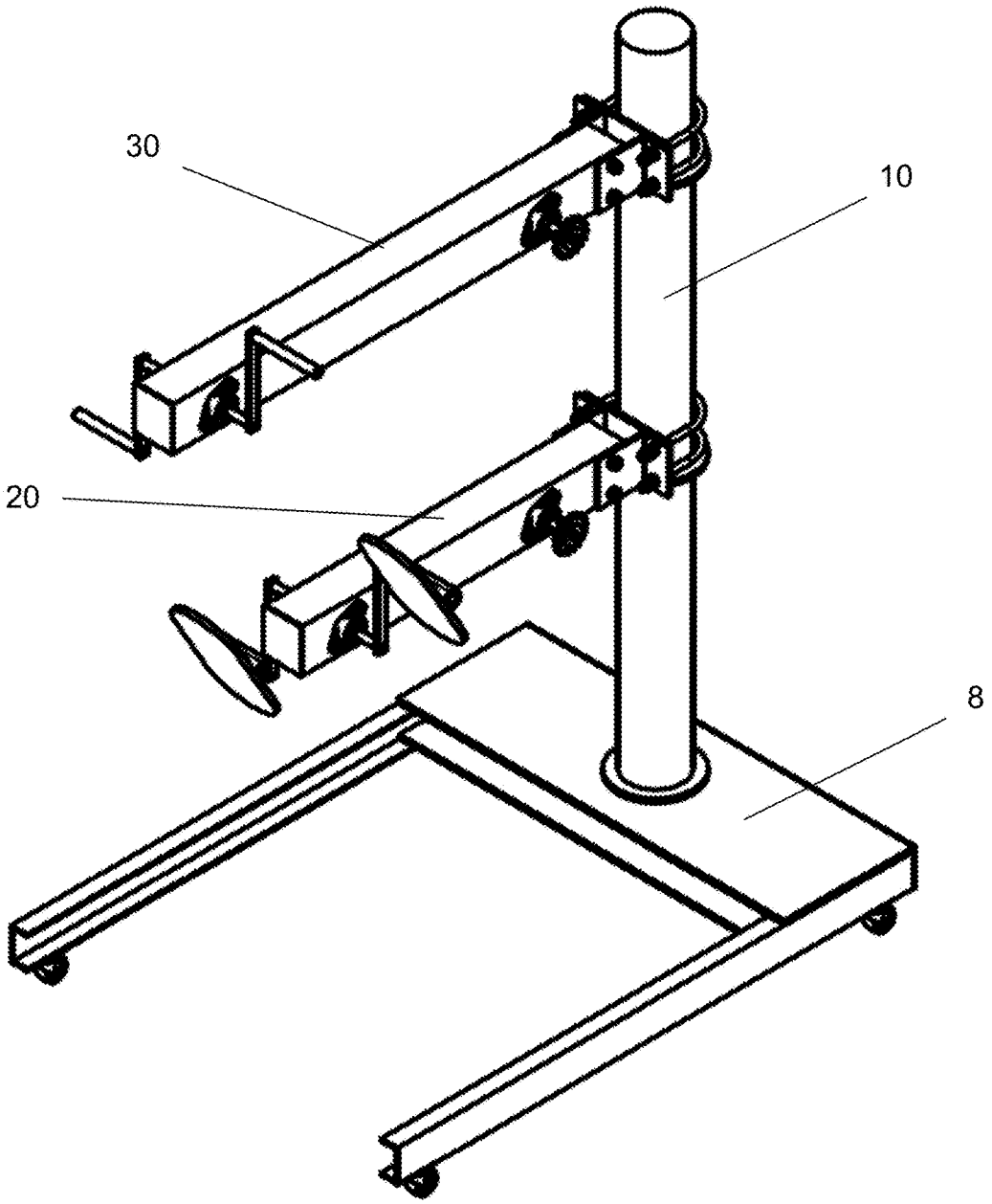
FIG. 8 shows a perspective view of an apparatus with both arms in a raised position
Figure 9:
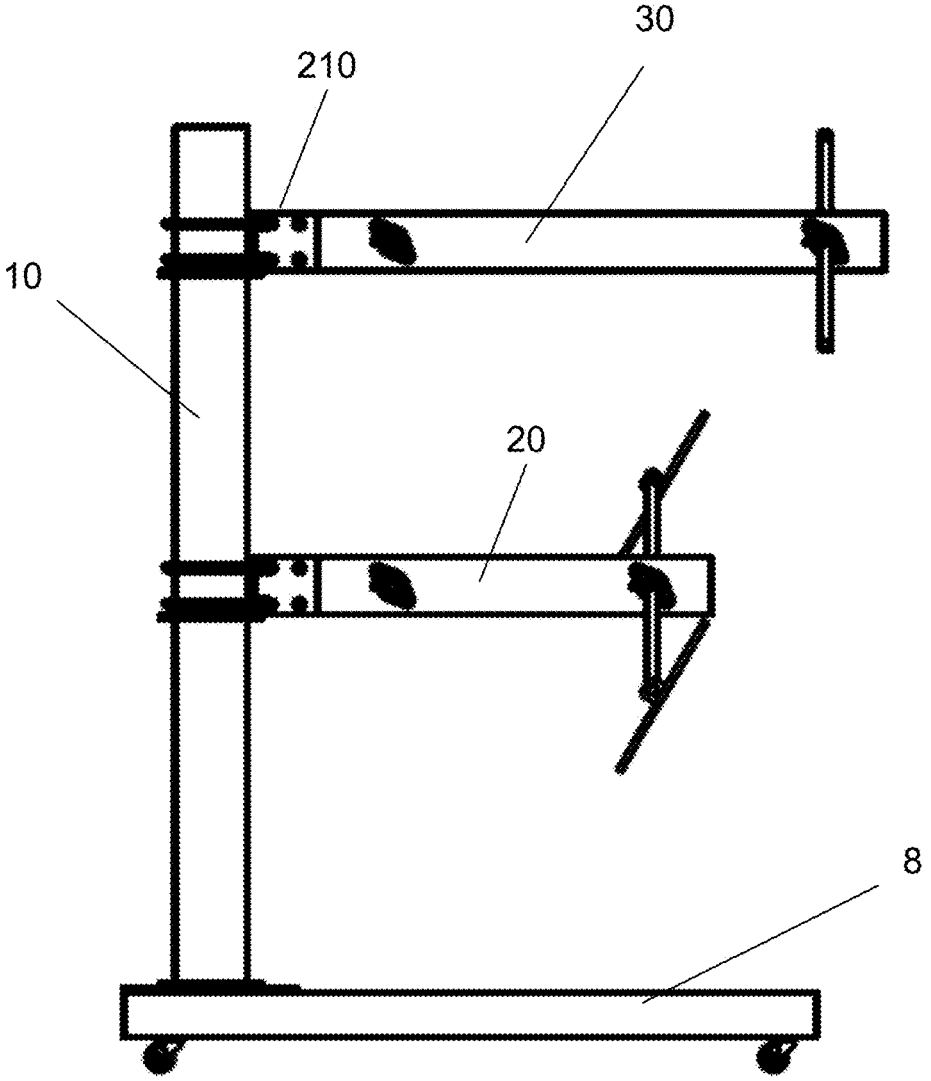
FIGS. 9 and 10 show side views of the apparatus of FIG. 8.
Figure 10:
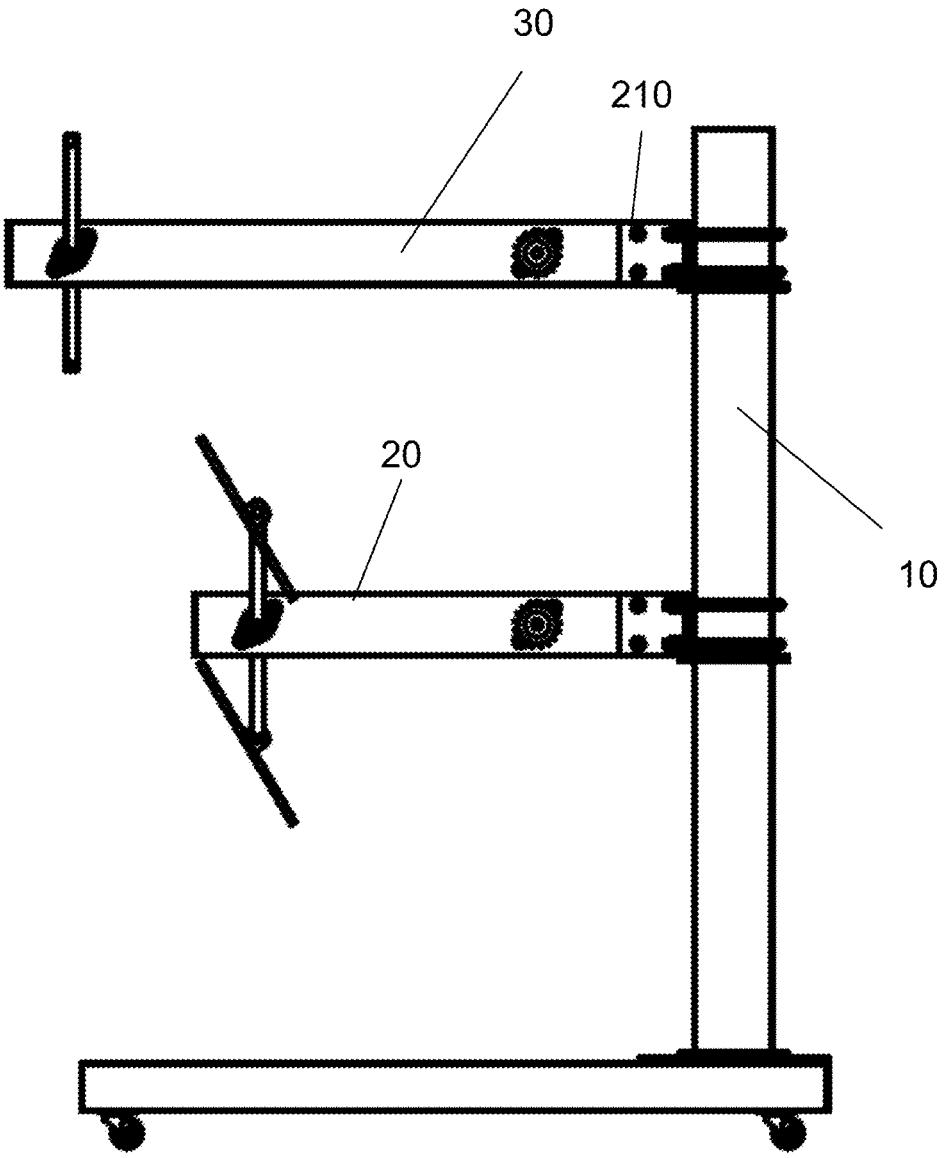
Figure 11:
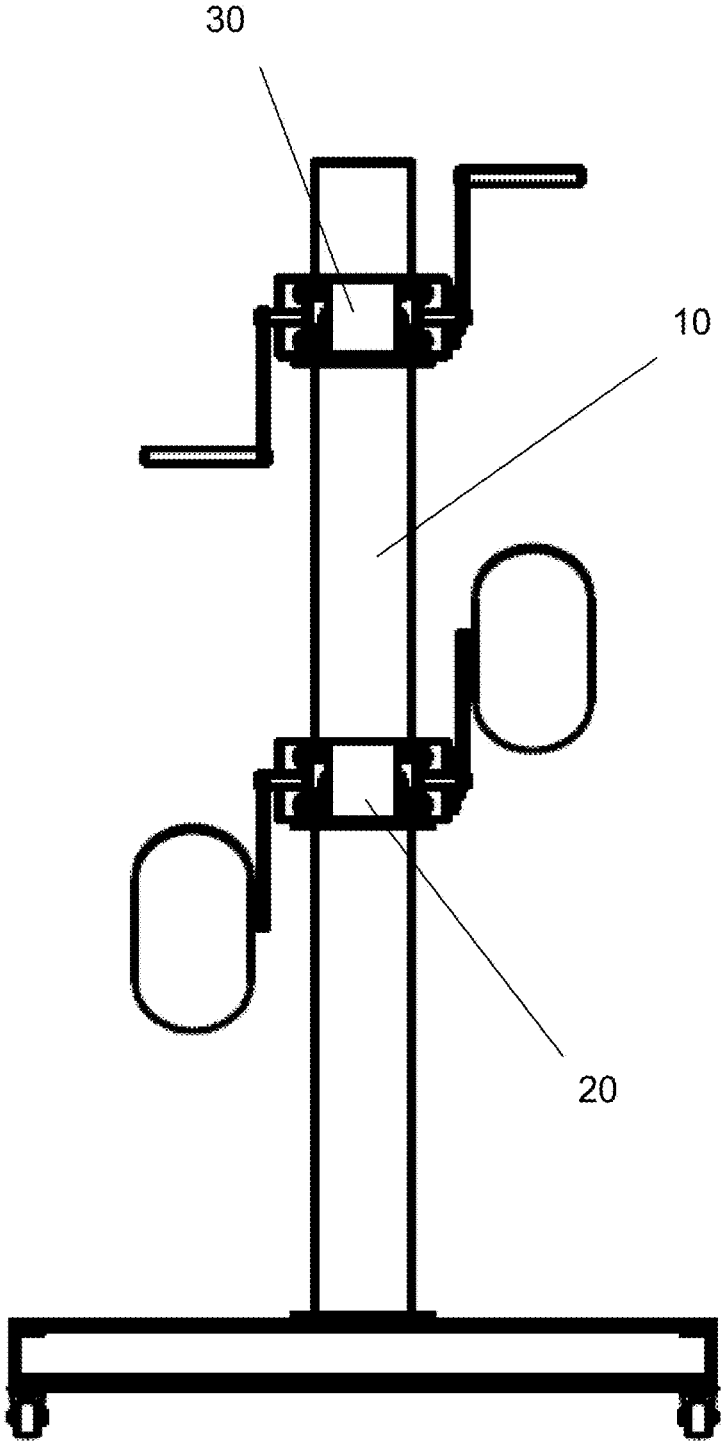
FIG. 11 shows a front view of the apparatus of FIG. 8.
Figure 12:
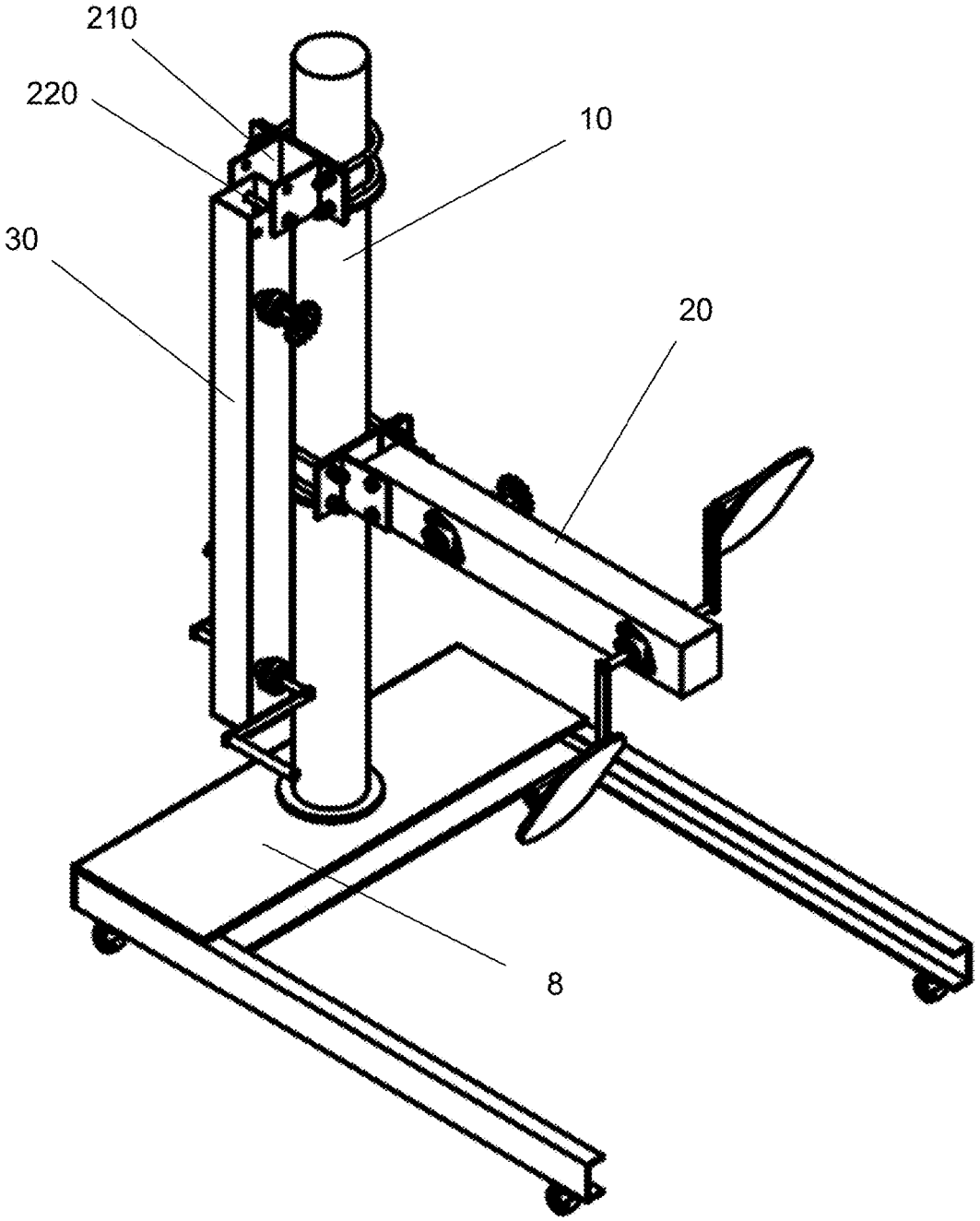
FIG. 12 shows a perspective view of the apparatus of FIG. 8 with the upper arm in a lowered position.
Figure 13:
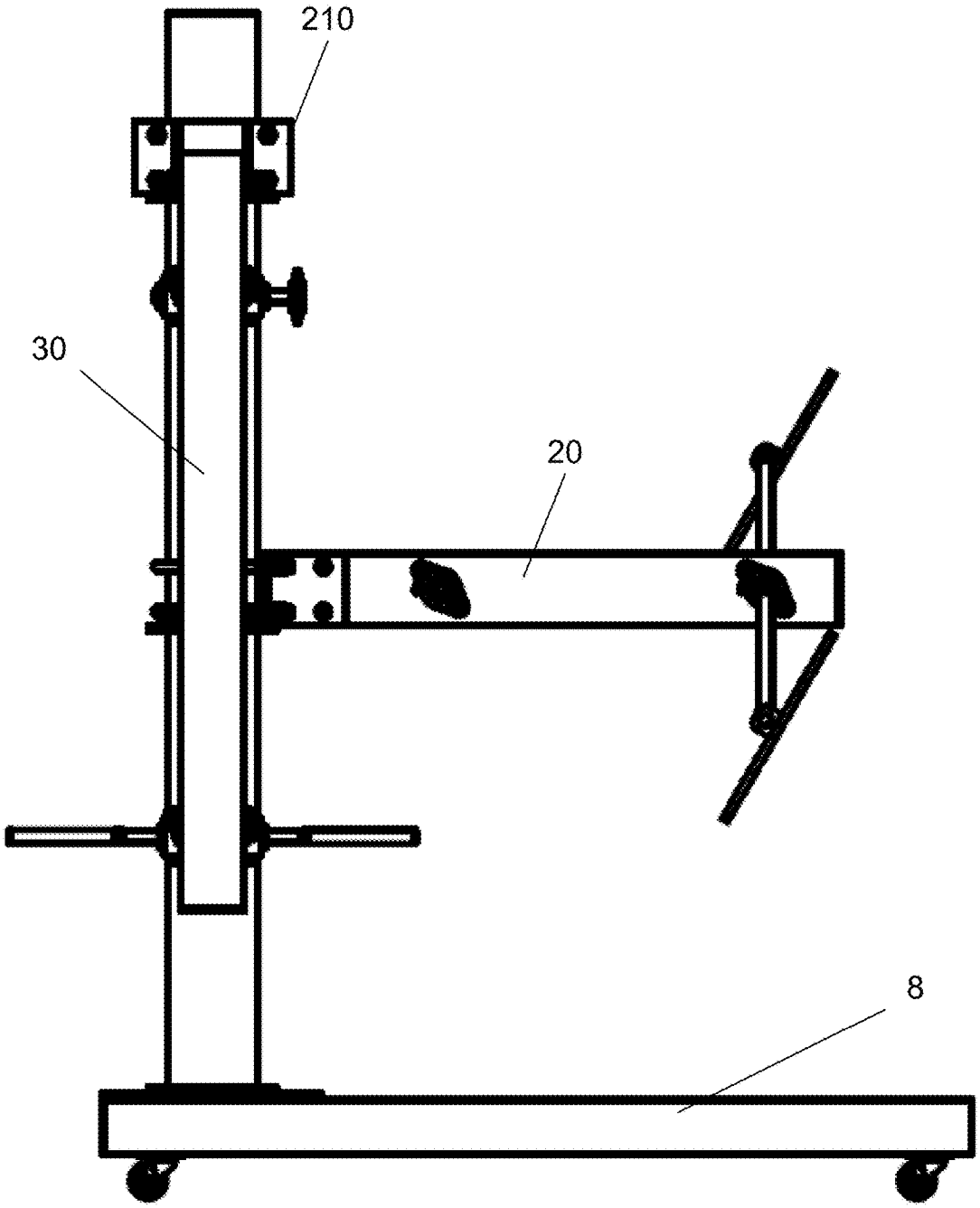
FIGS. 13 and 14 show sides views of the apparatus of FIG. 12.
Figure 14:
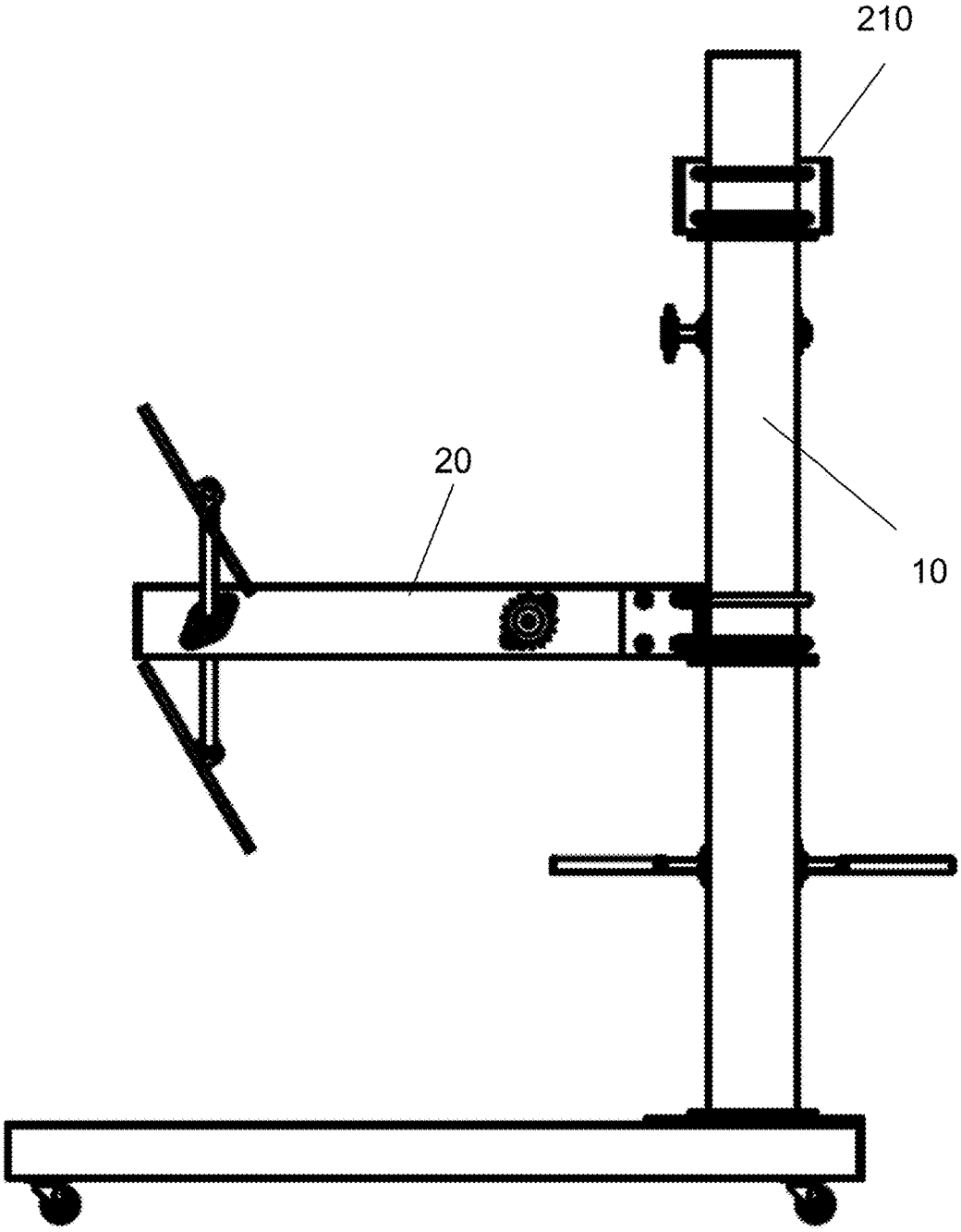
Figure 15:
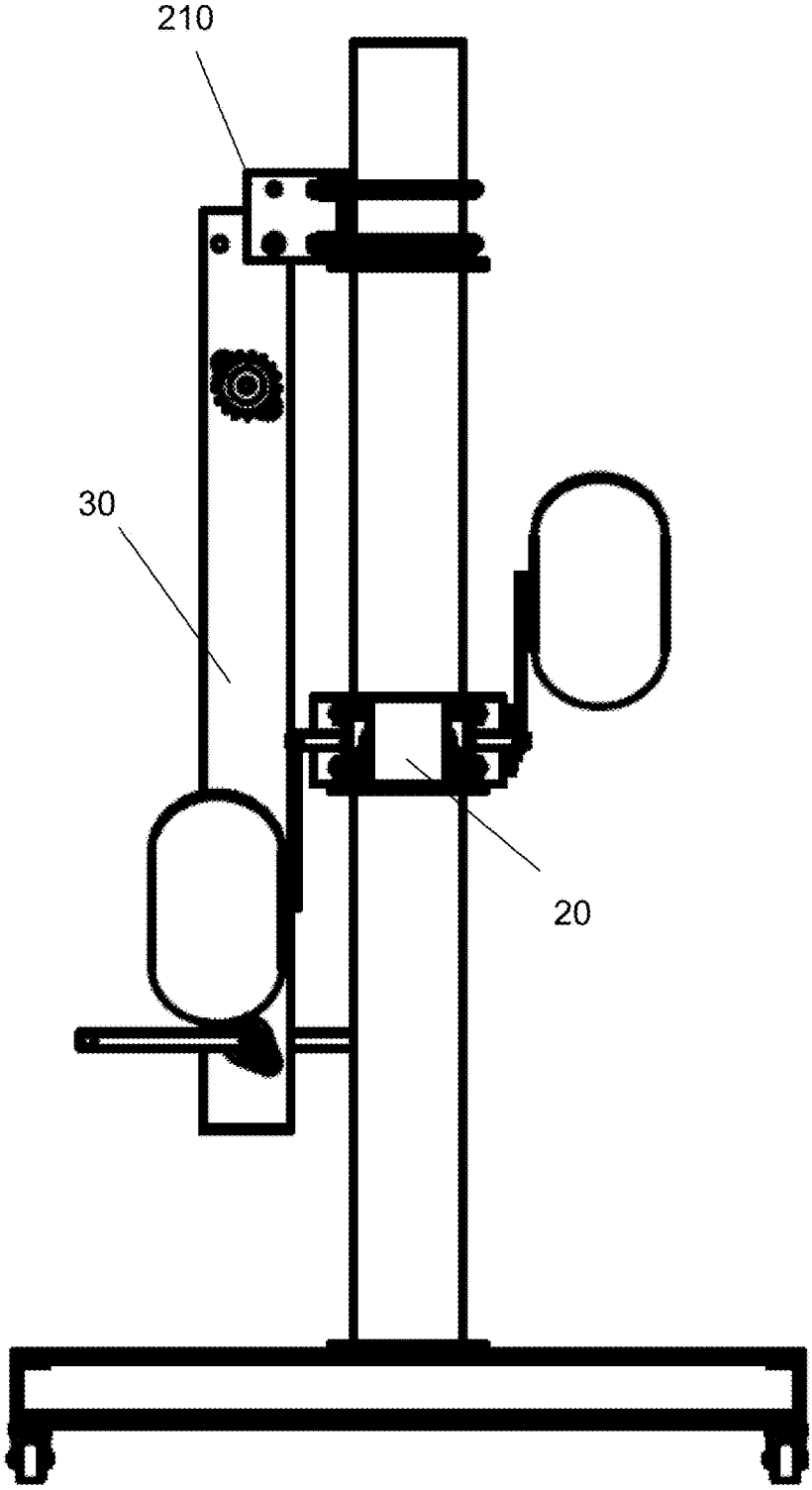
FIG. 15 shows a front view of the apparatus of FIG. 12.
Figure 16:
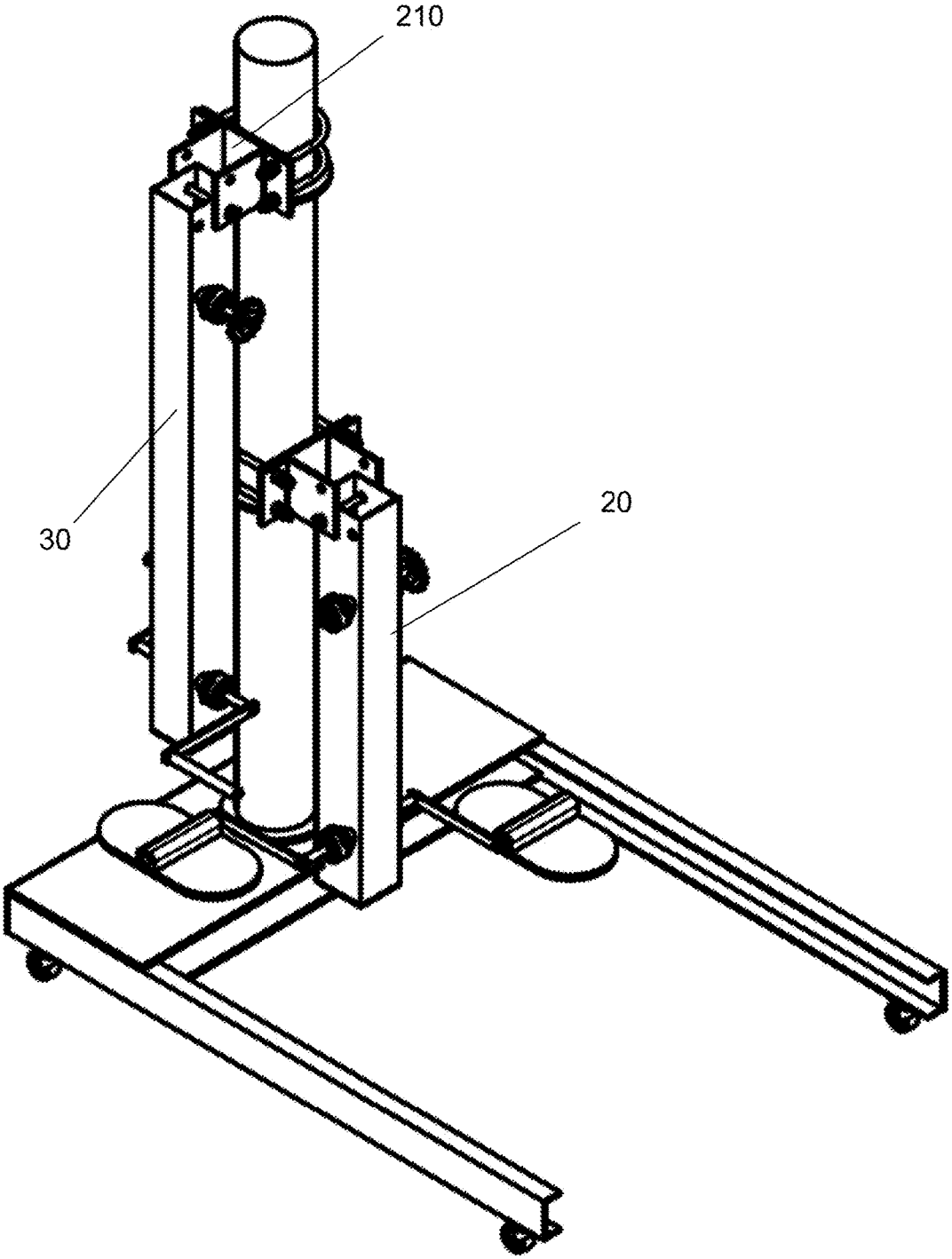
FIG. 16 shows a perspective view of the apparatus of FIG. 8 with the upper and lower arms in a lowered position.
Figure 17:
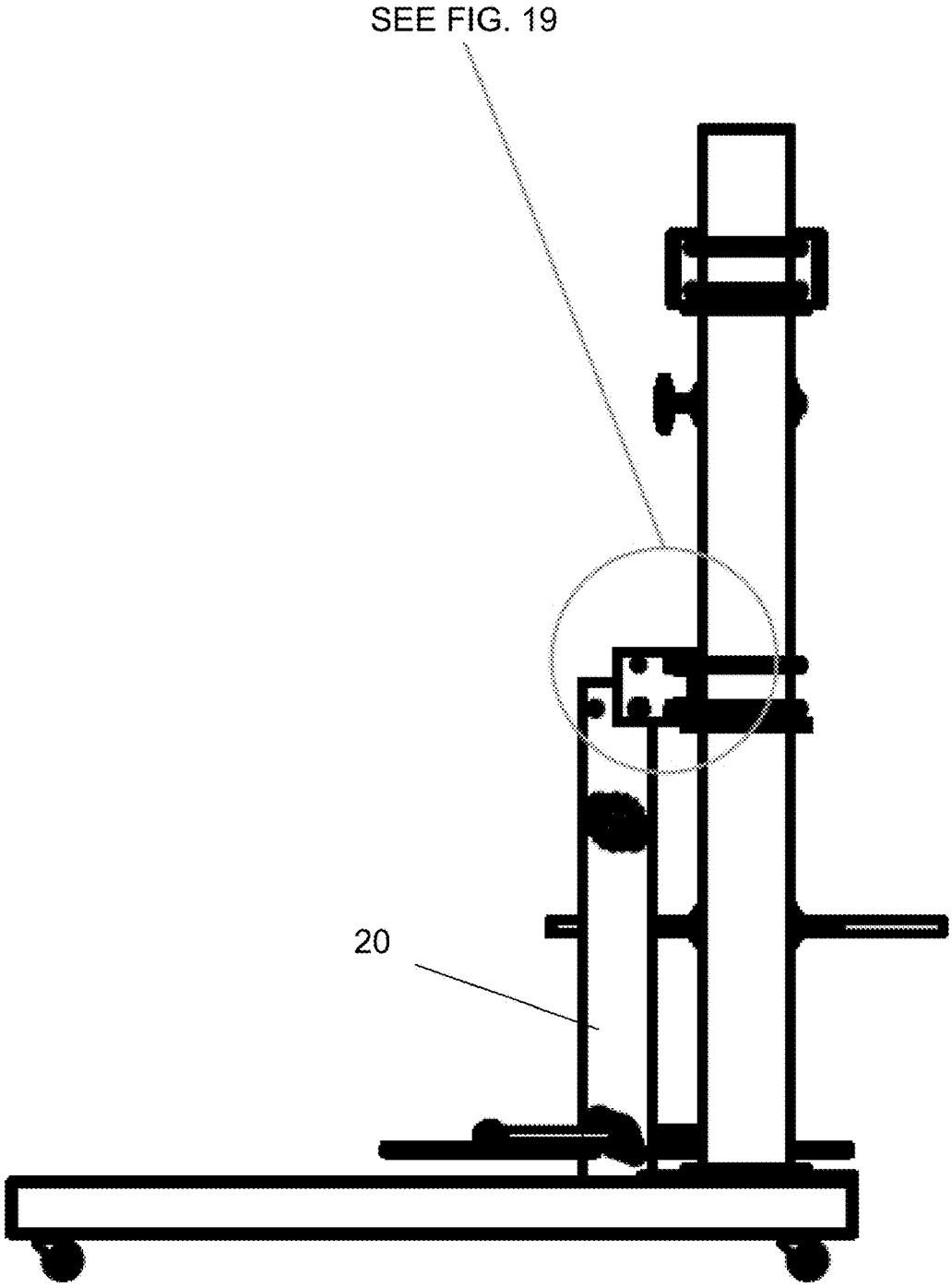
FIG. 17 shows a side view of the apparatus of FIG. 16.
Figure 18:
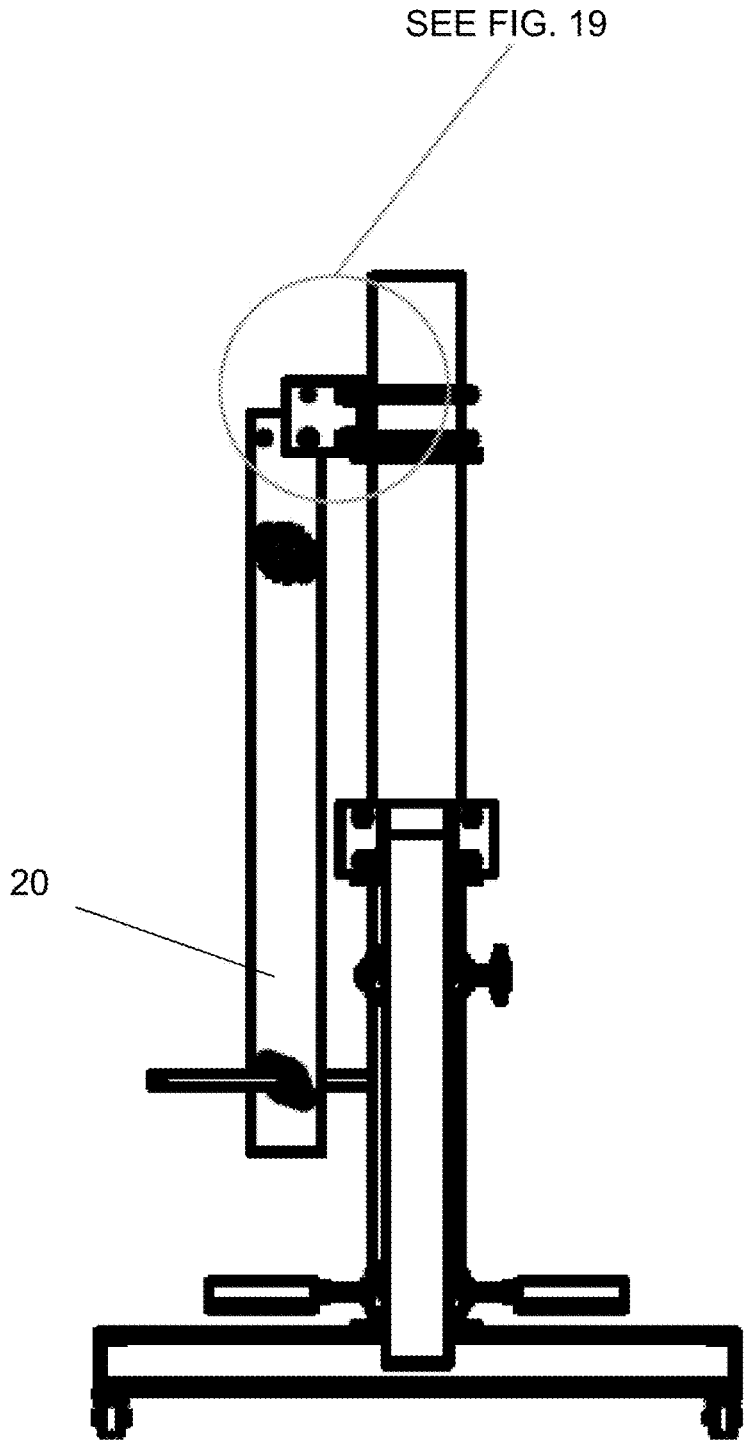
FIG. 18 shows a front view of the apparatus of FIG. 16.

In several embodiments, the arms 20, 30 rotate or swing around the support column 10, as seen in FIG. 7. Arms 20, 30 also may be lowered or raised in height. This facilitates the exact positioning of the rotary mechanisms for use with a particular individual, as well as helping with the use of one arm and accompanying rotary mechanism at a time. In yet another embodiment, as seen in FIGS. 8-19 the arms may be jointedly or hingedly 200 connected to the support column 10, whereby an arm can be unlocked at the joint and the distal end of the arm moved downward so that the arm rests parallel to the support column.

Figure 19:
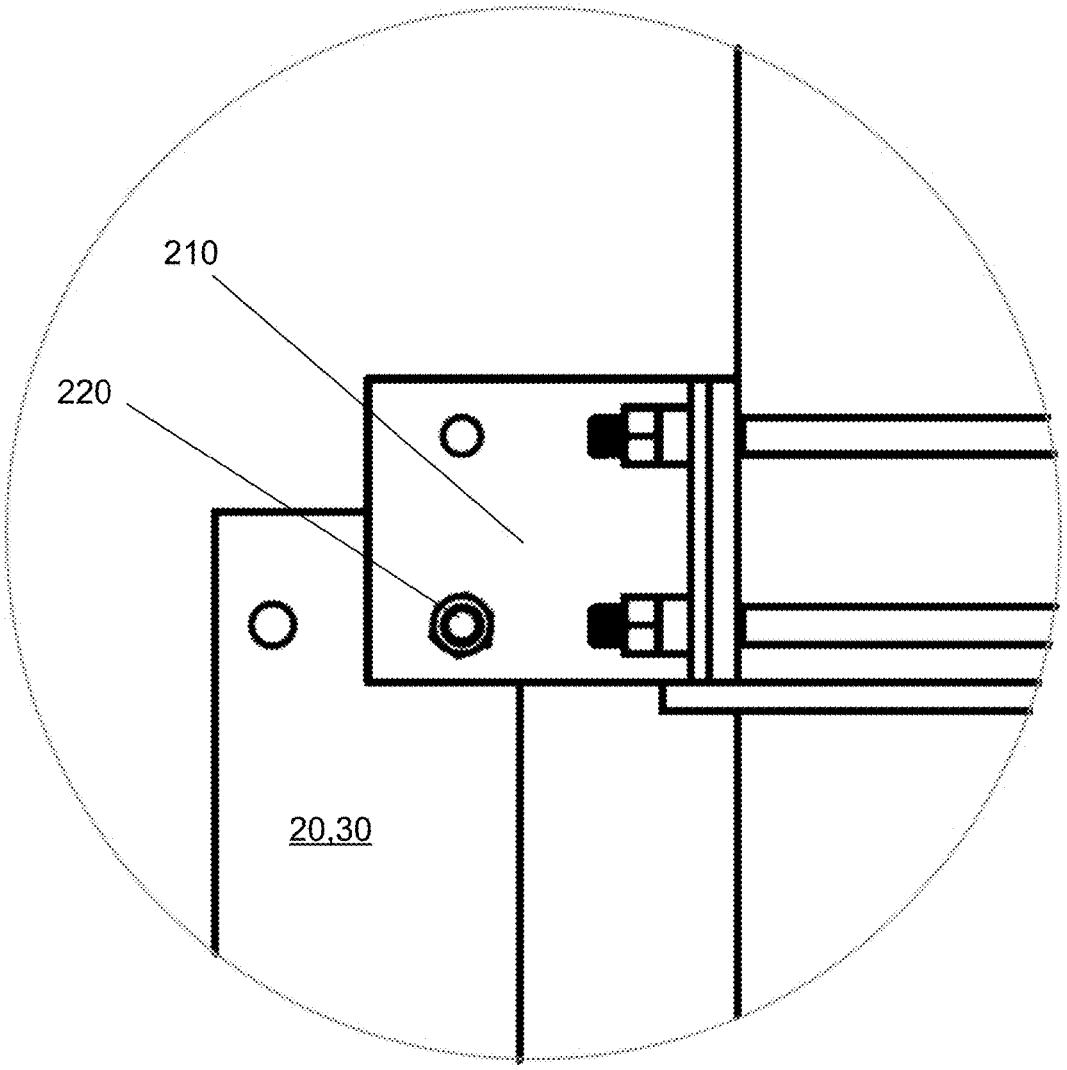
FIG. 19 shows a close-up view of a hinge joint.
Figure 20:
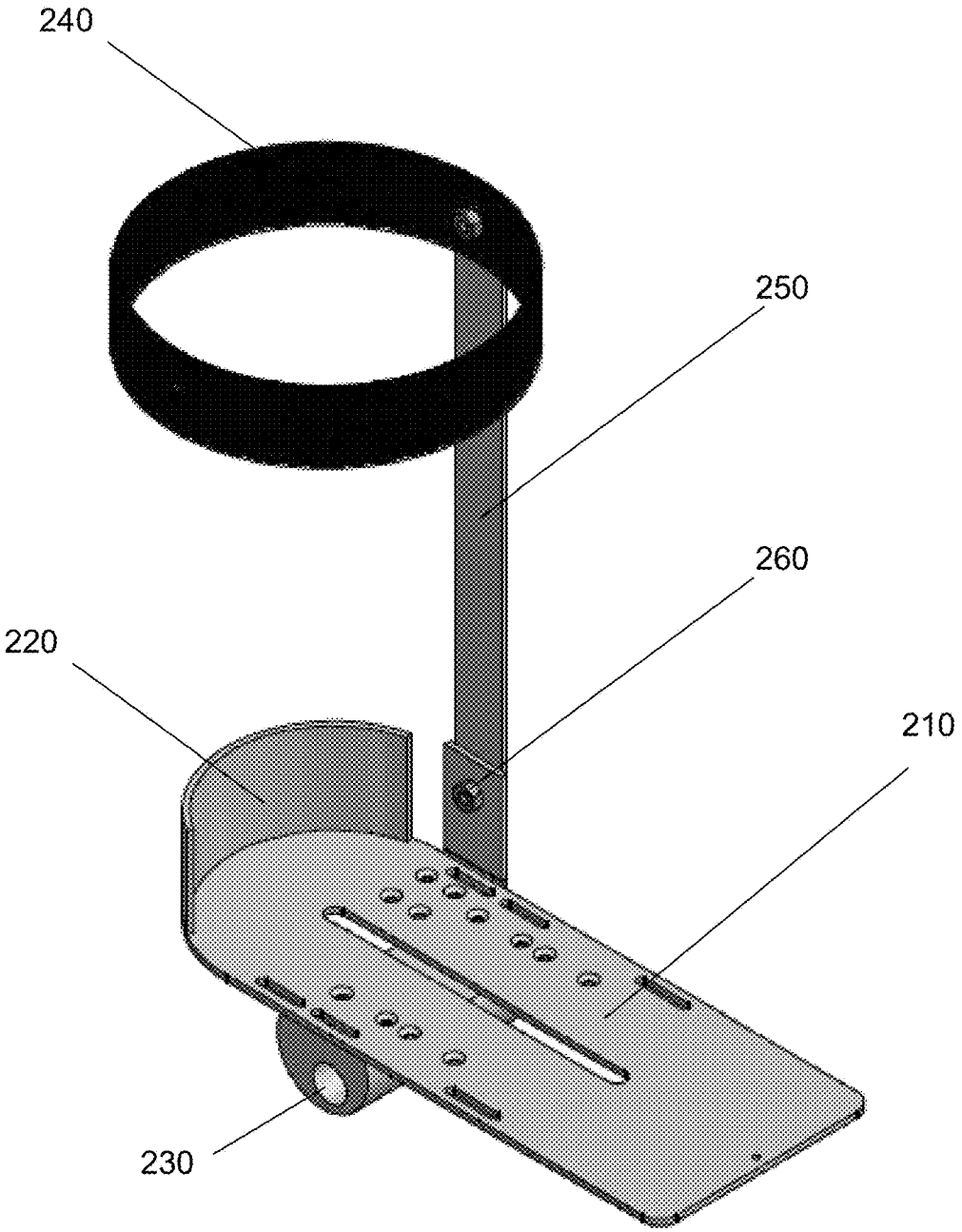
FIG. 20 shows a perspective view of a pedal with a calf strap, with the calf strap bar attached to the left side of the base plate.
Figure 21:
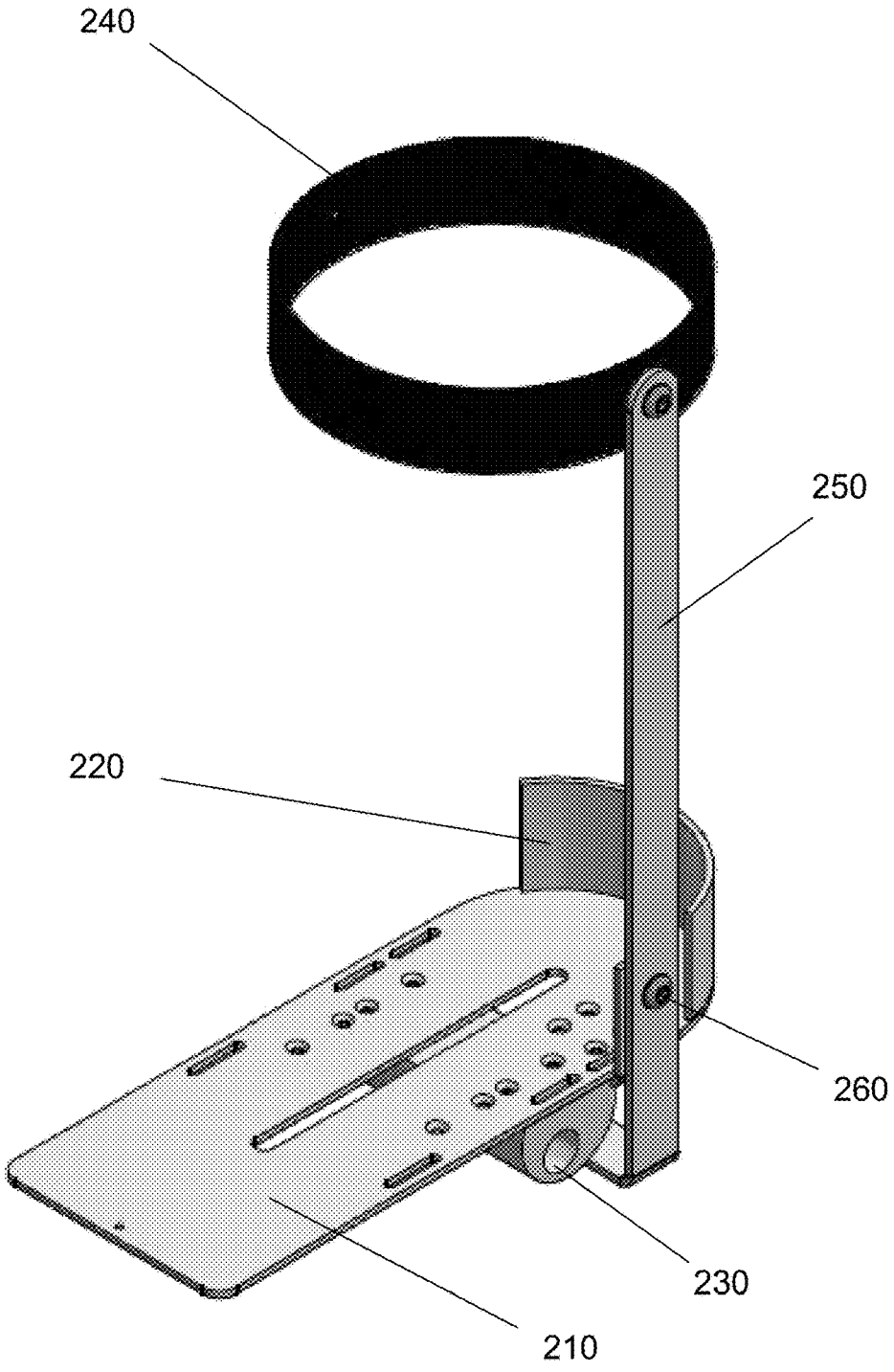
FIG. 21 shows a perspective view of a pedal with a calf strap, with the calf strap bar attached to the right side of the base plate.
Figure 22:
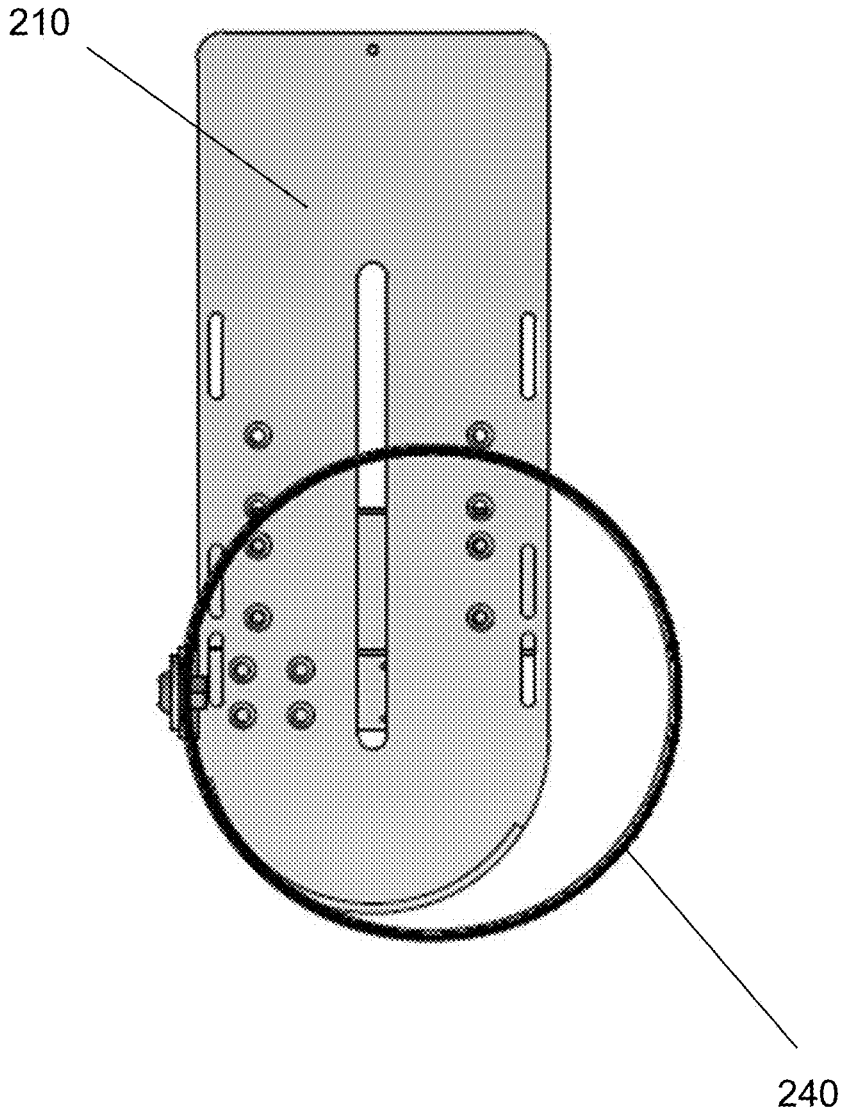
FIG. 22 shows a top view of the apparatus of FIG. 20.
Figure 23:
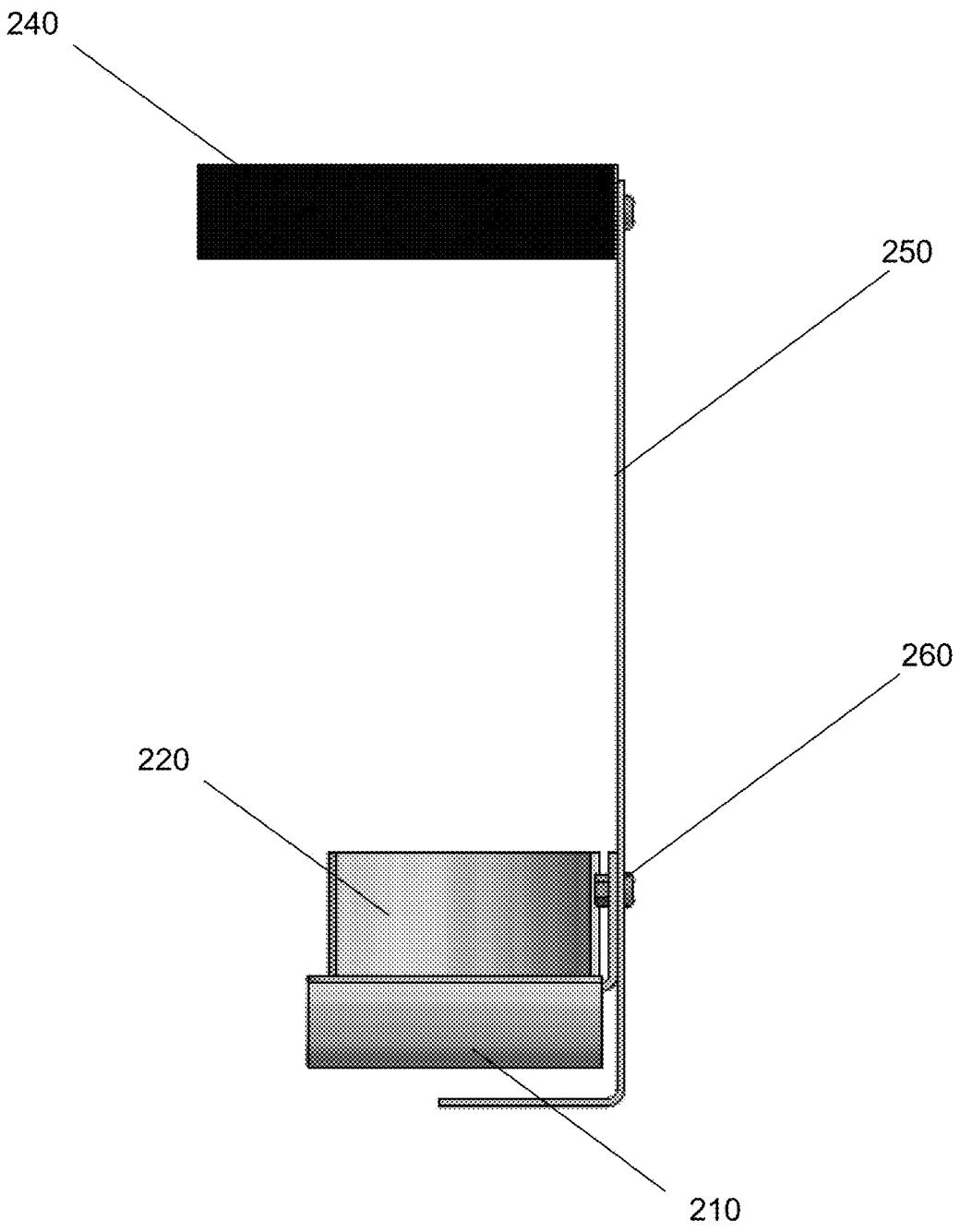
FIG. 23 show a rear view of the apparatus of FIG. 21.

An example of a hinge joint is seen in FIG. 19. In the example shown, the proximal end of the arm is connected to the support bracket 210, which is rotatably attached to the support column 10, by a pair of swivel pins or bolts 220. Release or removal of one swivel pin or bolt allows the arm to be rotated around the other swivel pint or bolt. In an alternative embodiment, a single swivel pin or bolt is used, and the arm is locked into position (such as by a screw lock) when rotated to the desired position.

The components of the apparatus may be made of any suitable material, including, but not limited to, metal, composite, plastic, wood, or combinations thereof. The apparatus provides therapeutic rehabilitation exercise to bedridden individuals and patients, including comatose individuals. It provides zero resistance therapy to those who are unable to be moved from a bed due to recent sickness, surgery, age, coma, or paralysis (e.g., wounded warriors, accident victims, elderly patients). Use of the apparatus increases blood flow to limbs for patients who are unable to move on their own, which, among other benefits, helps prevent blood clots, and provides bed-ridden, comatose patients with limb movement to combat muscle deterioration. It provides patients with artificial limbs the therapy to learn to use limbs equally and in sync with each other. It can also be used by mobile individuals for a variety of benefits, such as decreasing joint stiffness.

In order to provide a context for the programmable aspects of the invention, the following discussion provides a brief, general description of a suitable computing environment in which the various aspects of the present invention may be implemented. A computing system environment is one example of a suitable computing environment, but is not intended to suggest any limitation as to the scope of use or functionality of the invention. A computing environment may contain any one or combination of components discussed below, and may contain additional components, or some of the illustrated components may be absent. Various embodiments of the invention are operational with numerous general purpose or special purpose computing systems, environments or configurations. Examples of computing systems, environments, or configurations that may be suitable for use with various embodiments of the invention include, but are not limited to, personal computers, laptop computers, computer servers, computer notebooks, handheld devices, microprocessor-based systems, multiprocessor systems, TV set-top boxes and devices, programmable consumer electronics, cell phones, personal digital assistants (PDAs), network PCs, minicomputers, mainframe computers, embedded systems, distributed computing environments, and the like.

Embodiments of the invention may be implemented in the form of computer-executable instructions, such as program code or program modules, being executed by a computer or computing device. Program code or modules may include programs, objects, components, data elements and structures, routines, subroutines, functions and the like. These are used to perform or implement particular tasks or functions. Embodiments of the invention also may be implemented in distributed computing environments. In such environments, tasks are performed by remote processing devices linked via a communications network or other data transmission medium, and data and program code or modules may be located in both local and remote computer storage media including memory storage devices.

In one embodiment, a computer system comprises multiple client devices in communication with at least one server device through or over a network. In various embodiments, the network may comprise the Internet, an intranet, Wide Area Network (WAN), or Local Area Network (LAN). It should be noted that many of the methods of the present invention are operable within a single computing device.

A client device may be any type of processor-based platform that is connected to a network and that interacts with one or more application programs. The client devices each comprise a computer-readable medium in the form of volatile and/or nonvolatile memory such as read only memory (ROM) and random access memory (RAM) in communication with a processor. The processor executes computer-executable program instructions stored in memory. Examples of such processors include, but are not limited to, microprocessors, ASICs, and the like.

Client devices may further comprise computer-readable media in communication with the processor, said media storing program code, modules and instructions that, when executed by the processor, cause the processor to execute the program and perform the steps described herein. Computer readable media can be any available media that can be accessed by computer or computing device and includes both volatile and nonvolatile media, and removable and non-removable media. Computer-readable media may further comprise computer storage media and communication media. Computer storage media comprises media for storage of information, such as computer readable instructions, data, data structures, or program code or modules. Examples of computer-readable media include, but are not limited to, any electronic, optical, magnetic, or other storage or transmission device, a floppy disk, hard disk drive, CD-ROM, DVD, magnetic disk, memory chip, ROM, RAM, EEPROM, flash memory or other memory technology, an ASIC, a configured processor, CDROM, DVD or other optical disk storage, magnetic cassettes, magnetic tape, magnetic disk storage or other magnetic storage devices, or any other medium from which a computer processor can read instructions or that can store desired information. Communication media comprises media that may transmit or carry instructions to a computer, including, but not limited to, a router, private or public network, wired network, direct wired connection, wireless network, other wireless media (such as acoustic, RF, infrared, or the like) or other transmission device or channel. This may include computer readable instructions, data structures, program modules or other data in a modulated data signal such as a carrier wave or other transport mechanism. Said transmission may be wired, wireless, or both. Combinations of any of the above should also be included within the scope of computer readable media. The instructions may comprise code from any computer-programming language, including, for example, C, C++, C#, Visual Basic, Java, and the like.

Components of a general purpose client or computing device may further include a system bus that connects various system components, including the memory and processor. A system bus may be any of several types of bus structures, including, but not limited to, a memory bus or memory controller, a peripheral bus, and a local bus using any of a variety of bus architectures. Such architectures include, but are not limited to, Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computing and client devices also may include a basic input/output system (BIOS), which contains the basic routines that help to transfer information between elements within a computer, such as during start-up. BIOS typically is stored in ROM. In contrast, RAM typically contains data or program code or modules that are accessible to or presently being operated on by processor, such as, but not limited to, the operating system, application program, and data.

Client devices also may comprise a variety of other internal or external components, such as a monitor or display, a keyboard, a mouse, a trackball, a pointing device, touch pad, microphone, joystick, satellite dish, scanner, a disk drive, a CD-ROM or DVD drive, or other input or output devices. These and other devices are typically connected to the processor through a user input interface coupled to the system bus, but may be connected by other interface and bus structures, such as a parallel port, serial port, game port or a universal serial bus (USB). A monitor or other type of display device is typically connected to the system bus via a video interface. In addition to the monitor, client devices may also include other peripheral output devices such as speakers and printer, which may be connected through an output peripheral interface.

Client devices may operate on any operating system capable of supporting an application of the type disclosed herein. Client devices also may support a browser or browser-enabled application. Examples of client devices include, but are not limited to, personal computers, laptop computers, personal digital assistants, computer notebooks, hand-held devices, cellular phones, mobile phones, smart phones, pagers, digital tablets, Internet appliances, and other processor-based devices. Users may communicate with each other, and with other systems, networks, and devices, over the network through the respective client devices.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An exercise apparatus, comprising:

a main support column;

a first arm with a proximal end and a distal end, hingedly connected at a first height to the main support column at the proximal end;

a second arm with a proximal end and a distal end, hingedly connected at a second height to the main support column at the proximal end, wherein the second height is greater than the first height;

a first rotary mechanism located at the distal end of the first arm, said first rotary mechanism adapted to move a set of pedals in a rotary fashion; and a second rotary mechanism located at the distal end of the second arm, said second rotary mechanism adapted to move a set of handles in a rotary fashion.

2. The apparatus of claim 1, further comprising a base with a plurality of wheels, casters or rollers affixed to the bottom side of the base.

3. The apparatus of claim 2, wherein one or more of said plurality of wheels, casters or rollers are lockable.

4. The apparatus of claim 1, further comprising at least one motor mechanically connected to said first or second rotary mechanisms or both.

5. The apparatus of claim 4, further comprising one or more belts and pulleys connecting said motor to said first or second rotary mechanisms, or both.

6. The apparatus of claim 4, further comprising one or more chains and gears connecting said motor to said first or second rotary mechanisms, or both.

7. The apparatus of claim 4, further comprising at least one battery providing power to said motor.

8. The apparatus of claim 4, wherein said at least one motor is located within the main support column.

9. The apparatus of claim 1, wherein said first arm, second arm, or both, are rotatably connected to the main support column and rotate laterally with respect to the support column.

10. The apparatus of claim 1, further wherein the set of handles comprises straps or brackets.

11. The apparatus of claim 1, further wherein the set of pedals comprises straps or brackets.

12. The apparatus of claim 1, further comprising a control panel.

13. The apparatus of claim 12, wherein the control panel comprises a processor or microprocessor, and said processor or microprocessor is programmed to control the speed and direction of rotation of said rotary mechanisms.

14. The apparatus of claim 1, wherein the main support column is telescoping.

15. The apparatus of claim 1, wherein the apparatus is independent of any user support or bed.

* * * * *